US007721446B2

(12) United States Patent
Royle

(10) Patent No.: US 7,721,446 B2
(45) Date of Patent: May 25, 2010

(54) WET RAZOR WITH CONFORMING BLADE SUPPORT

(75) Inventor: Terence Gordon Royle, Oakley (GB)

(73) Assignee: The Gillette Company, Boston, MA (US)

( * ) Notice: Subject to any disclaimer, the term of this patent is extended or adjusted under 35 U.S.C. 154(b) by 308 days.

(21) Appl. No.: 11/803,497

(22) Filed: May 15, 2007

(65) Prior Publication Data

US 2008/0022530 A1 Jan. 31, 2008

(30) Foreign Application Priority Data

Jul. 28, 2006 (GB) ..... 0615113.8

(51) Int. Cl.
*B26B 21/22* (2006.01)
*B26B 21/40* (2006.01)

(52) U.S. Cl. ..... 30/49; 30/50

(58) Field of Classification Search ..... 30/32, 30/47, 49, 50, 51, 62, 63
See application file for complete search history.

(56) References Cited

U.S. PATENT DOCUMENTS

| | | | | |
|---|---|---|---|---|
| 3,587,171 | A * | 6/1971 | Perry | 30/40.1 |
| 4,069,580 | A * | 1/1978 | Cartwright et al. | 30/47 |
| 4,443,939 | A * | 4/1984 | Motta et al. | 30/49 |
| 4,516,320 | A | 5/1985 | Peleckis | |
| 4,720,917 | A * | 1/1988 | Solow | 30/49 |
| 4,754,548 | A | 7/1988 | Solow | |
| 4,854,043 | A | 8/1989 | Chen | |
| 4,976,028 | A | 12/1990 | Chen | |
| 6,430,814 | B1 * | 8/2002 | Solow | 30/47 |
| 6,772,523 | B1 * | 8/2004 | Richard et al. | 30/527 |
| 6,804,886 | B2 | 10/2004 | Wain | |
| 7,024,776 | B2 | 4/2006 | Wain | |
| 2004/0020053 | A1 | 2/2004 | Wain | |
| 2008/0196251 | A1 * | 8/2008 | Royle | 30/50 |
| 2009/0100680 | A1 * | 4/2009 | Royle et al. | 30/43.92 |

FOREIGN PATENT DOCUMENTS

| | | |
|---|---|---|
| EP | 1 236 547 | 9/2002 |
| GB | 2 119 690 | 11/1983 |
| GB | 2 318 999 | 5/1998 |
| WO | WO 89/06587 | 7/1989 |
| WO | WO 92/06828 | 4/1992 |
| WO | WO 95/29798 | 11/1995 |
| WO | WO 99/04938 | 2/1999 |
| WO | WO 2004/073939 | 9/2004 |

OTHER PUBLICATIONS

International Search Report with Written Opinion in corresponding Int'l appln. PCT/IB2007/052889 dated Feb. 11, 2008.

* cited by examiner

*Primary Examiner*—Hwei-Siu C Payer
(74) *Attorney, Agent, or Firm*—John M. Lipchitz; Kevin C. Johnson; Steven W. Miller

(57) ABSTRACT

A safety razor assembly having a blade structure including one or more flexible elongate blades supported by a structure that is deformable to permit the blade structure to flex to follow concave or convex curvatures. The support structure can include two suspension members supporting a blade structure along respective edges, and each suspension member has several support elements interconnected by hinges and in sliding cooperation with the blade structure. The deformation of the suspension members is guided by a guide arrangement located adjacent the suspension members.

19 Claims, 35 Drawing Sheets

WET RAZOR WITH CONFORMING BLADE SUPPORT

CROSS REFERENCE TO RELATED APPLICATION

This application claims the benefit of priority from GB 0615113.8, filed Jul. 28, 2006, the contents of which is hereby incorporated by reference herein in its entirety.

FIELD OF THE INVENTION

This invention is concerned with safety razors, also called wet razors that exhibit a high degree of conformance to the surface being shaved.

BACKGROUND OF THE INVENTION

There are known wet or safety razors that are intended to provide a degree of conformance to skin curves. These are disclosed in U.S. Pat. No. 7,024,776 (Wain), and a blade suitable for use therein shown in U.S. Pat. No. 6,804,886 (Wain). United States Patent WO 99/04938 (Hawes et al.) proposes a flexible support for a shaving cartridge. Other suggestions known in the art for flexible blade supports are for example the following U.S. Pat. No. 4,754548 (Solow); U.S. Pat. No. 4,976,028 (Chen); U.S. Pat. No. 4,854,043 (Chen); and U.S. Pat. No. 4,516,320 (Peleckis). Powered, electric razors employing inner and outer cooperating shearing members such as "foils" supported to adapt in use are known from EP-A-1449627 (Uchiyama), and EP-A-1454720, but those constructions limit conformance during use. As described in EP-A-1449627 with reference to FIG. 2 therein, the outer foil cutter (20) is fixed to the inside of the casing (22) at anchoring positions (24), and this inevitably reduces the flexing capabilities. Furthermore, the U-shaped foil configuration also acts to resist flexing of the foil along its length and, as the blade support bends the blades spread apart or come together so that distances separating the shearing edges of adjacent blades are changed and the shaving performance is consequently affected, which is undesirable. EP-A-1454720 describes a similar foil and cutter assembly but differs in that the inner cutter, instead of being resilient, is shaped so that the foil has a concave curvature along its length. A second foil and cutter assembly with a straight convex or concave configuration can be provided alongside the concave assembly. In this case, maintaining proper cooperation between the cutter blades and the foil over the full length of the foil becomes a problem when the inner cutter is reciprocated relative to the foil.

SUMMARY OF THE INVENTION

The present invention has for an object to at least alleviate the limitations of the prior art as explained above and to satisfy the need for a safety razor construction that can achieve improved contact and conformity between the blade and a curved skin contour.

Provided in accordance with the invention is an assembly in or for a safety razor, comprising an elongate flexible blade structure comprising one or more blades, characterized in that the blade structure is carried on a supporting structure that is deformable to permit the blade structure to flex, and that the supporting structure comprises a series of elements spaced apart along the blade structure and so linked together, such as by hinged connections, that the blade can flex to follow concave or convex curvatures along the length thereof.

The cutting performance remains substantially constant irrespective of the flexing of the blade or blades to conform to convex or concave skin curvatures. A supporting structure consisting of a series of spaced elements can provide effective supporting at a large number of points along the blade structure without seriously impairing the flexing capability of the blade. Preferably the number of support elements in the series is at least several, in particular at least five, and ideally around 10 or more, and there can be as many as 20 or 25. From 8 to 22, more especially 12 to 18 support elements are favorable. Conveniently the blade support elements are uniformly spaced apart along the blades, and preferably the blade support elements are linked together by integral hinged connections and extend from the hinged connections to free ends at which the blade structure is supported. The blade structure is preferably slidably received by the support structure and in a simple but highly effective construction the blade support elements have notches at the free ends, and a side edge portion of the blade structure is received in and guided by the notches. Longitudinal movement of the blade or blades is generally undesirable and the blade structure can conveniently be provided with a detent for engaging a blade support element to retain the blade structure against any longitudinal movement at the location of the engaged element. At least some movement in the longitudinal direction is permitted between the blade structure and other support elements so that flexing of the blade structure is not hindered. In order to minimize such relative movement the detent is preferably located at a medial position along the blade structure.

In its simplest form the blade structure can consist of a single elongate flexible blade mounted to the supporting structure, but it may also comprise a plurality of blades mounted on the supporting structure independently of each other. Conveniently, however, the blade structure includes one or more blades assembled in a frame having an elongate flexible member or part that cooperates with the support elements of the supporting structure. Conveniently, blades of the type disclosed in U.S. Pat. No. 6,804,886 B2 (Wain) can be used, the entire disclosure of which is incorporated by reference hereby. Another alternative with the scope of the invention is a blade structure comprising a flexible plate or sheet with a number of through holes, e.g. circular holes, which holes have cutting edges extending at least partially around their peripheries.

To control deformation of the supporting structure a guide arrangement is preferably included in the assembly for guiding relative movement of the linked support elements. The guide arrangement can include a frame in which the supporting structure is carried and at least two of the elements can be guided to move along substantially linear paths. In particular two elements can be guided in the longitudinal direction and a further element can be guided in a direction substantially perpendicular to the longitudinal direction. In this way a symmetrical form can be maintained as the blade structure and the supporting structure flex and change curvature. Conveniently the guided elements have lateral projections that engage in guide slots formed in an adjacent frame member.

One embodiment of the invention has two series of linked support elements for supporting the blade structure. A uniform support for the blade structure can be ensured by a symmetrical arrangement of the two series of linked supporting elements. One series of support elements can support the blade structure along a first edge portion, and the second series of support elements can be arranged to support the blade structure along another edge portion of the blade structure located opposite the first edge portion.

The supporting structure with the series of link support elements is conveniently mounted in a frame including an opposed pair of plates and at least one spacer disposed between the plates. Slots for guiding movement of the series of linked support elements can be provided in a frame plate. In addition, or alternatively, a spacer may include guide means for guiding movement of the support elements during deformation of the supporting structure. For example, the guide means can comprise a slot in the spacer and a slide member fixed to the supporting structure and engaged in the slot.

As previously mentioned the blade structure may include a flexible base frame. The base frame is preferably flat and may be stamped from a thin metal sheet or may be formed of plastic material. An edge portion of the base frame can be engaged with the series of linked support elements and/or each blade can be connected to the base frame at a plurality of positions along the blade. In one construction the base frame comprises opposed, parallel edge portions interconnected by bridging strips and end strips to which the blade or blades may be connected by any suitable means, such as spot welds or by adhesive. Alternatively, blade mounts may be disposed on the flexible base frame at spaced positions and be provided with slots or otherwise adapted to receive the at least one blade.

Another possibility is for the support elements to have blade seats thereon. The blade seats may be provided on support bridges that interconnect the upper ends of pairs of opposed support elements of two symmetrically arranged series of linked support elements. The blade seats conveniently comprise slots to receive the at least one blade of the blade structure.

The blade slots, whether in the blade mounts or formed by the blade seats are conveniently configured to receive a planar blade and to orientate the blade in an inclined disposition with the cutting edge uppermost.

When the blade structure includes a flexible base frame this frame can conveniently carry a guard member, for example a guard member of elastomeric material that may be molded in situ onto the base frame. The guard member may be positioned between an edge portion of the base frame which is engaged with the supporting structure and the at least one blade. Another possibility is for the guard member to be carried on a part of the base frame disposed remotely from an edge portion engaged with the supporting structure with respect to the at least one blade. In this case the part of the base frame carrying the guard member can be connected to the edge portion by a plurality of projecting frame pieces spaced apart along the edge portion. The guard member is preferably formed in one piece and extends continuously along the base frame.

Another form of guide arrangement to guide movement of the support elements comprises a guide member disposed adjacent the supporting structure, the guide member including a rigid central part with a pair of opposed arm extending therefrom, and coupling members, ideally hinged to the arms and connected pivotally to the supporting structure, coupled between the arms and the supporting structure adjacent the opposite ends of the supporting structure. The central part of the guide member is suitably engaged slidably with a slide member connected to a medial part of the supporting structure for guiding movement thereof. A guide slot can be defined by the guide member and be engaged by a slide block connected to the supporting structure.

In addition to providing support for the blade structure, the supporting structure can support a separate skin contact member, such as a strip containing an agent, e.g. a lubricating agent, for application to the skin during shaving. The skin contact member may additionally or alternatively constitute a source of other shaving enhancement products know per se. Conveniently the skin contact member includes opposed longitudinal edges slidably engaged with the supporting elements, and the longitudinal edges can be provided by a flexible carrier plate of the skin contact member.

It may be desirable for the support elements of the supporting structure to carry respective segments of a skin contacting member, particularly an elastomeric guard member, or a lubricating strip, which can be molded in one piece with the segments being interconnected by intervening webs.

The foregoing and other advantageous features of the preferred embodiments of this invention will become apparent from the detailed description which follows, reference being made to the accompanying drawings.

DETAILED DESCRIPTION OF THE INVENTION

Figure 1:
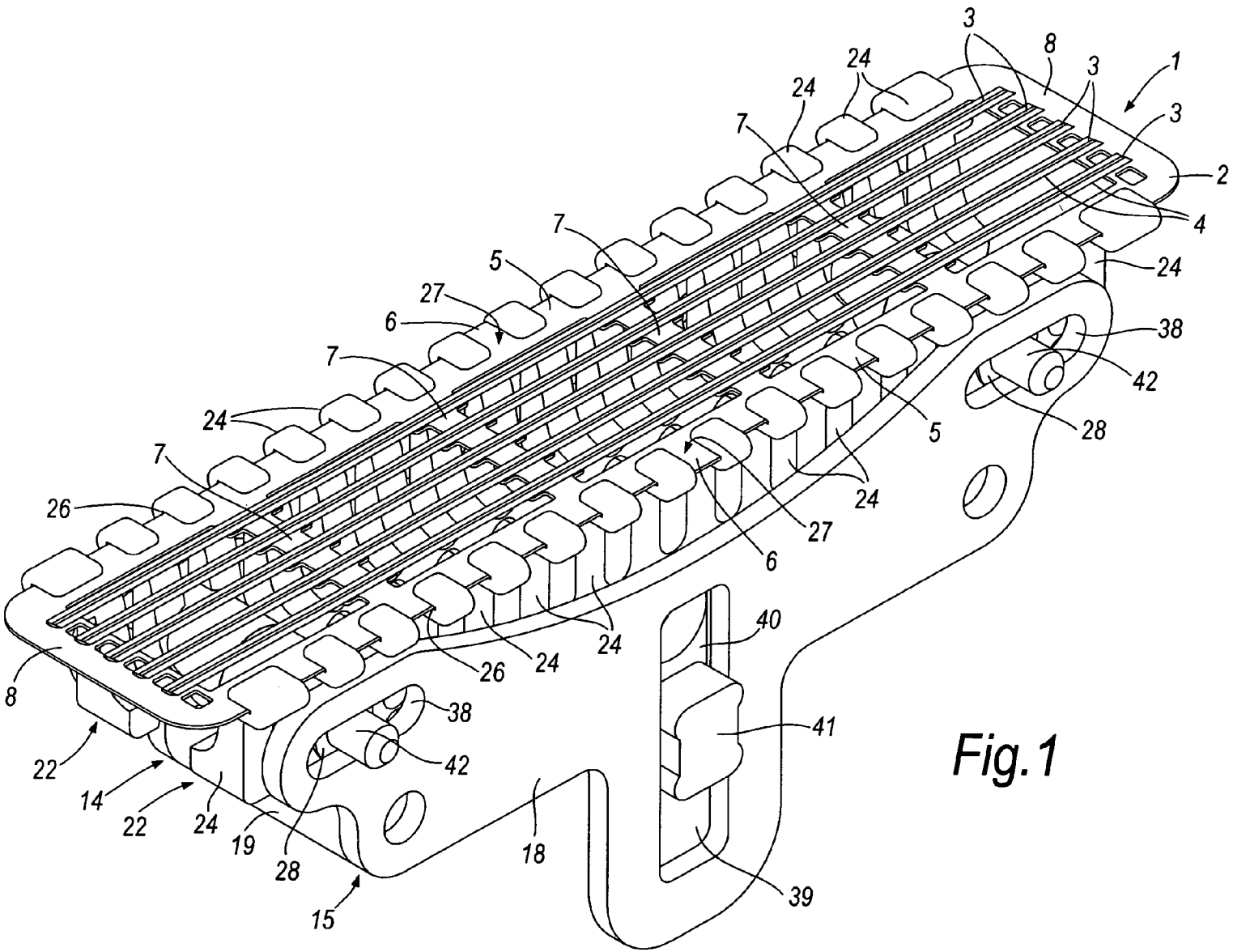
FIG. 1 is an isometric view of showing a first embodiment of a safety razor blade unit assembly in accordance with the invention.
Figure 2:
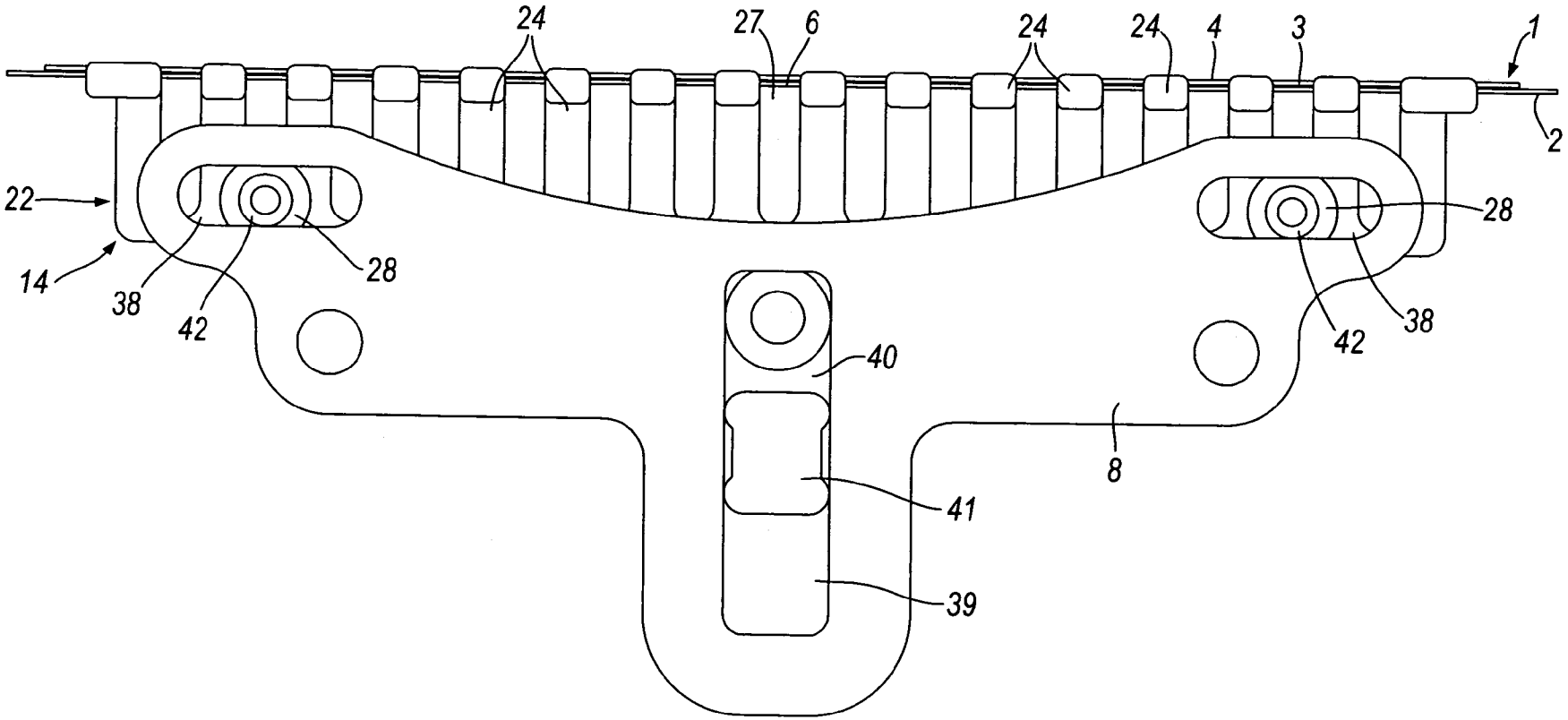
FIG. 2 is a front elevation of the blade unit shown in FIG. 1.
Figure 3:
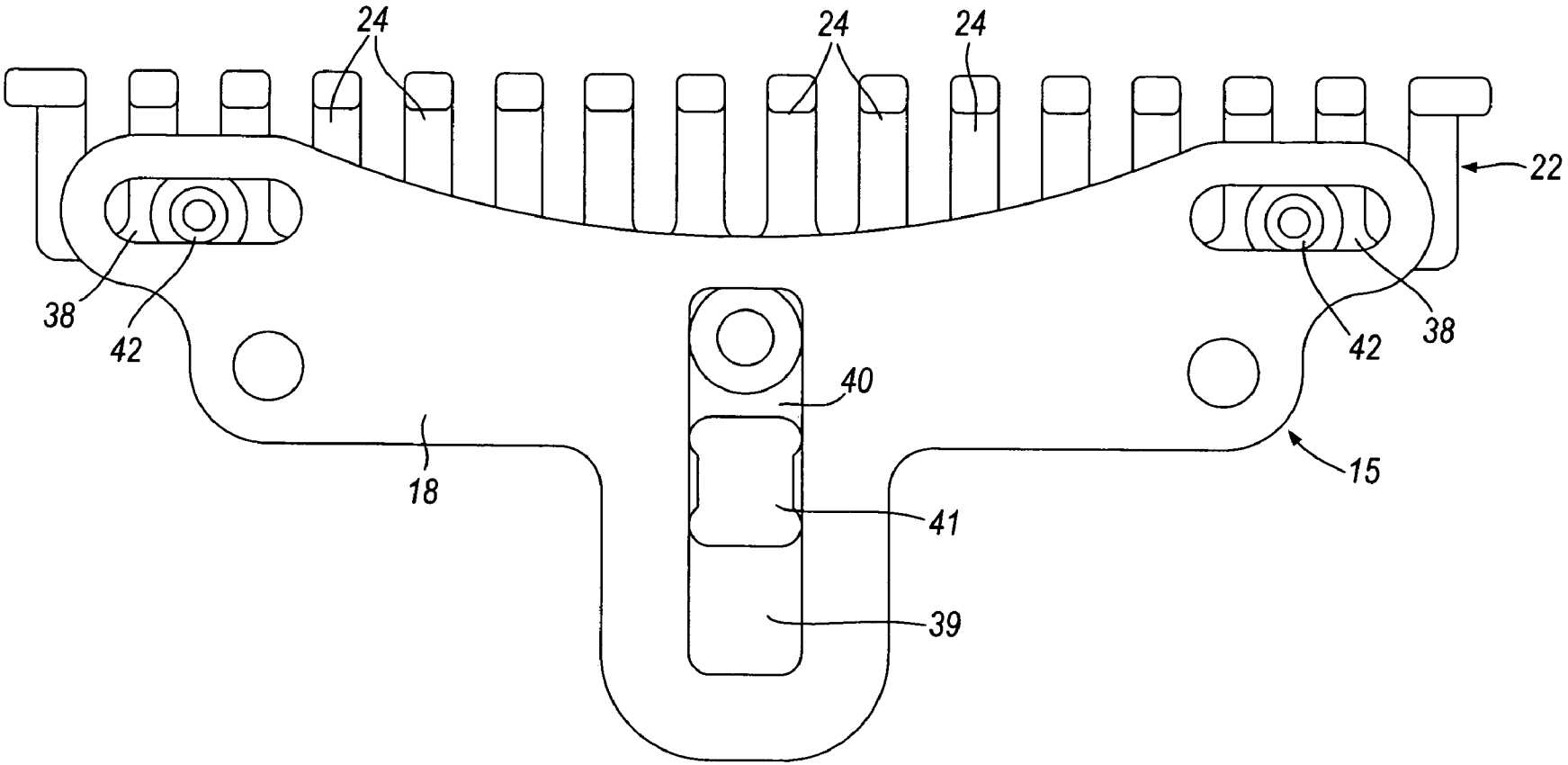
FIG. 3 is a front elevation of the blade unit shown in FIG. 1 with the blade structure omitted.
Figure 4:
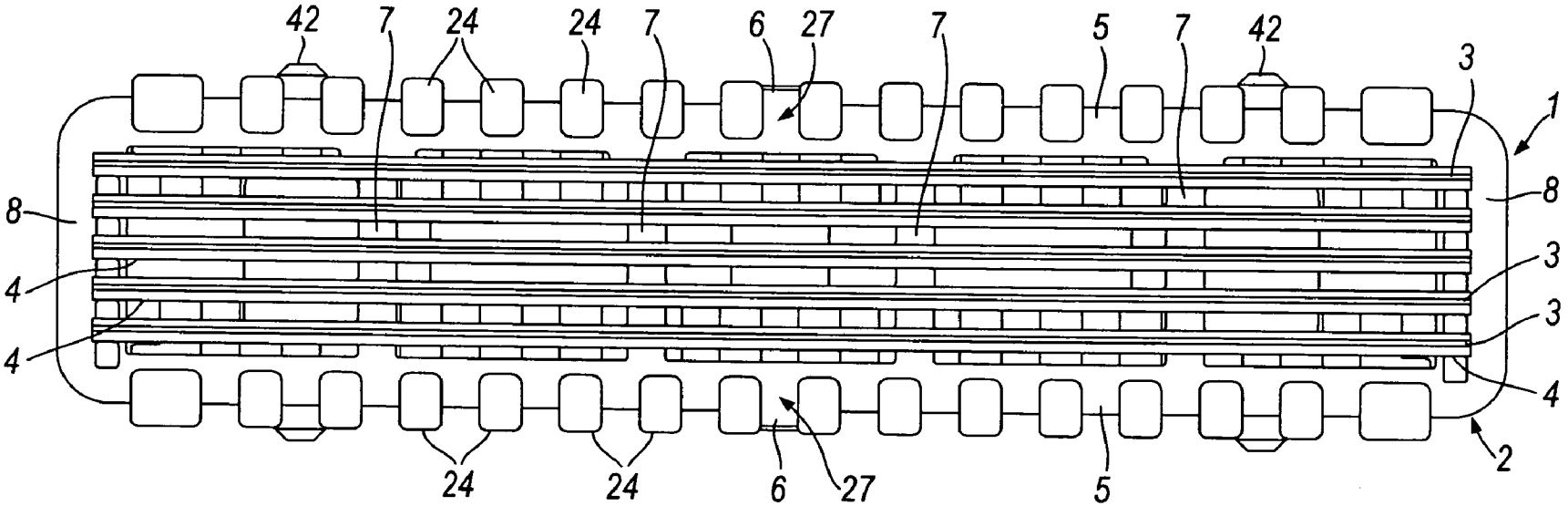
FIG. 4 is a top plan view of the blade unit shown in FIG. 1.
Figure 5:
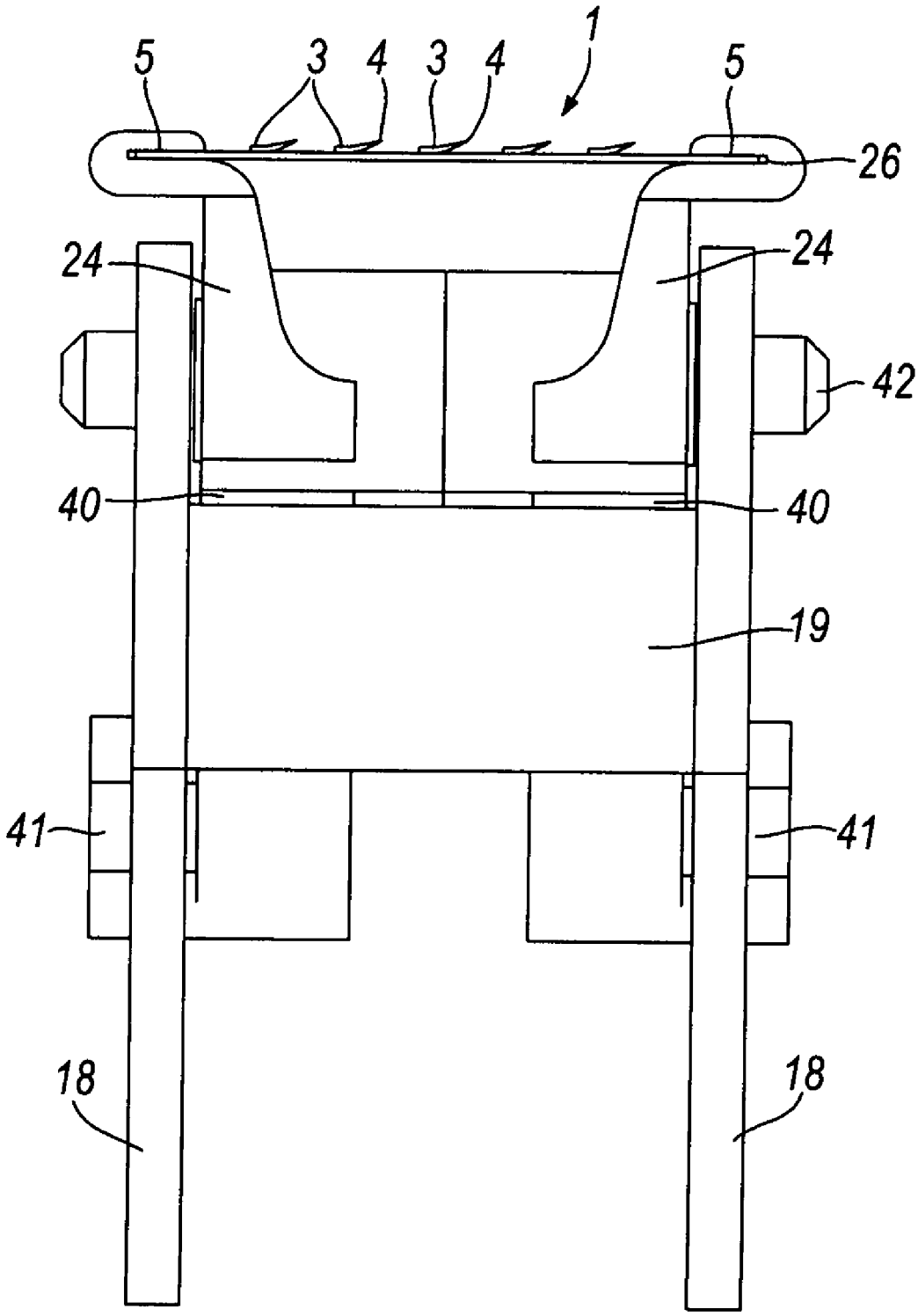
FIG. 5 shows the blade unit of FIG. 1 in end elevation.
Figure 6:
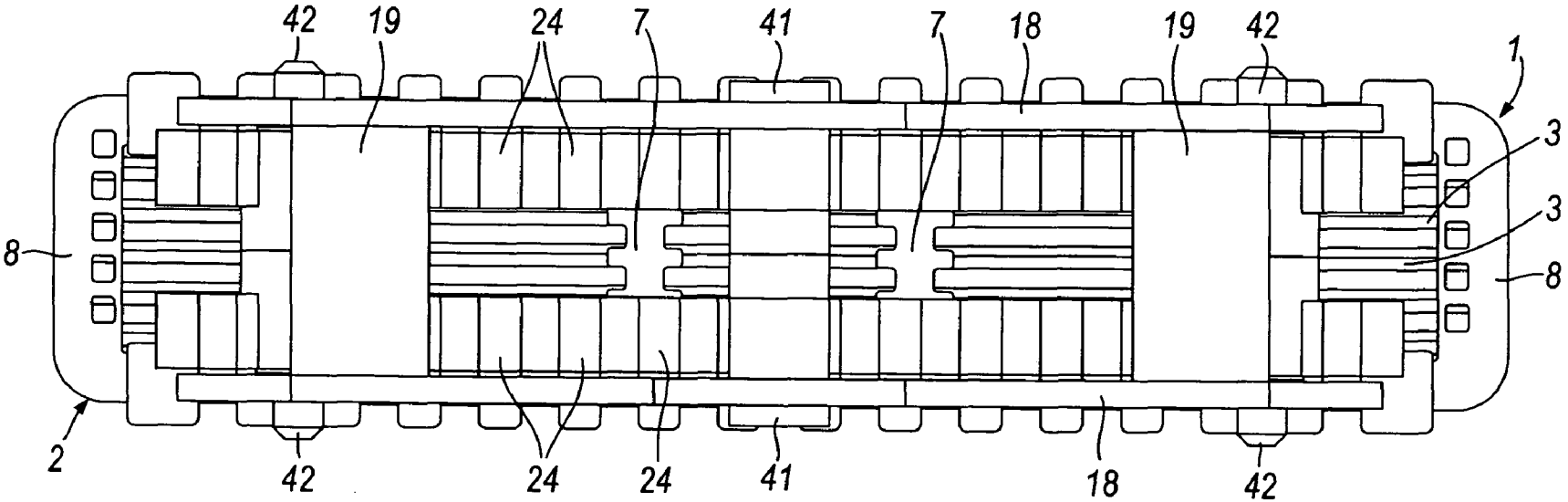
FIG. 6 is an underneath plan of the blade unit shown in FIG. 1.
Figure 7:
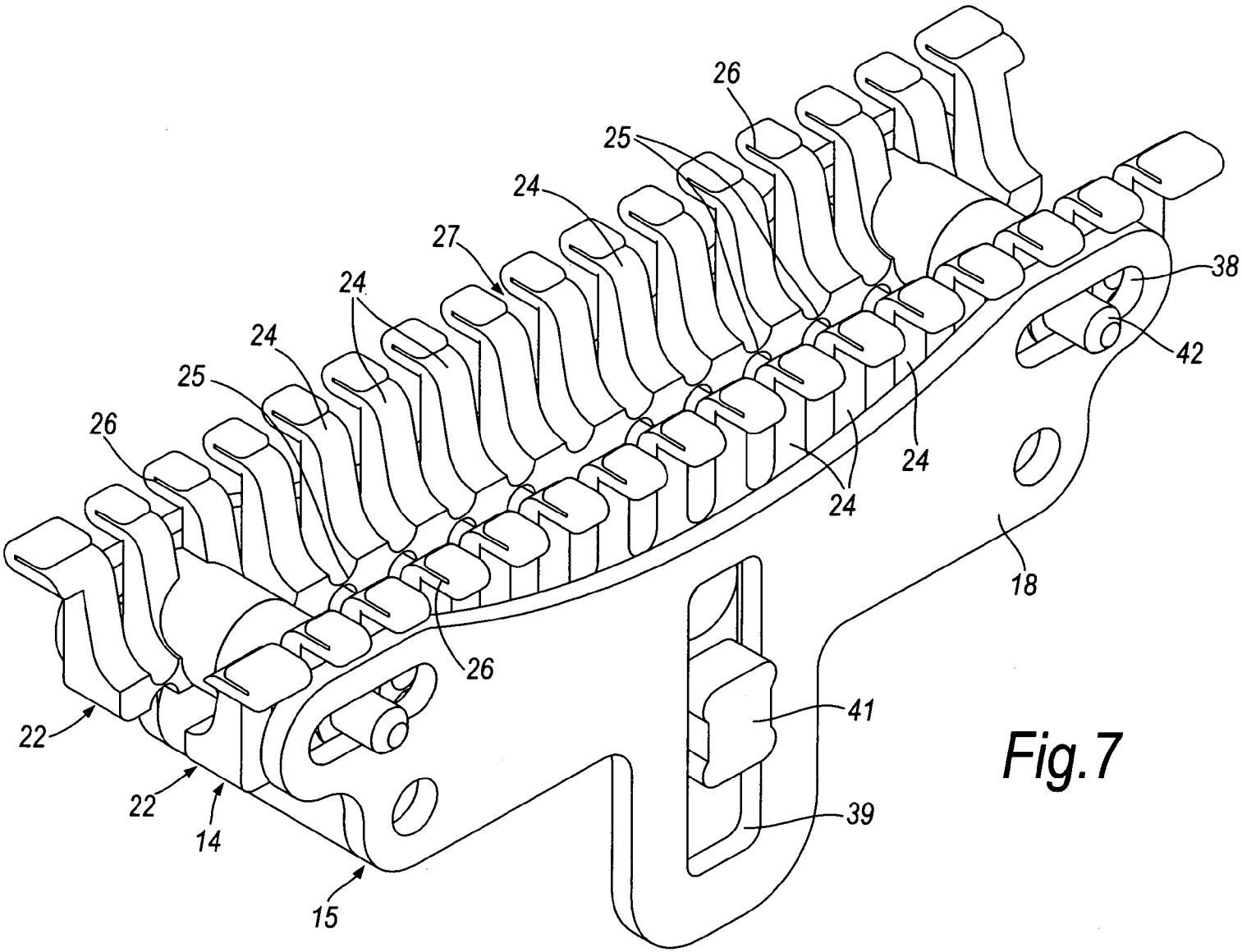
FIG. 7 is an isometric view of the blade unit of FIG. 1 with the blade structure removed.

Throughout the drawings and the description which follows the same reference numerals have been used to designate corresponding parts and components in the respective embodiments and unless otherwise indicated the description of any part given with respect to one embodiment will apply equally to corresponding parts of other embodiments designated with the same reference numerals.

The safety razor blade units illustrated in the drawings are in use mounted on razor handles, either permanently so that the entire razor is discarded when the sharpness of the blades has reduced to an unsatisfactory level, or replaceably so that a used blade unit can be replaced by a fresh blade unit with sharp blades. If desired the blade unit can be pivotably mounted on the handle in a manner well known per se. The attachment of the blade units to the razor handle forms no part of the present invention, for which purpose any suitable connection structure can be employed and will not be described further.

The blade unit of FIGS. 1 to 12 has a flexible blade structure 1 which includes a generally flat base frame 2 on which a plurality of blades, namely five blades 3 as shown, are carried. The base frame includes edge portions 5 for supporting the blade structure 1 at the edges without impeding contact between the cutting edges 4 of the blades 3 and the skin being shaved. Protruding outwardly from each edge portion 5 of the frame 2 is a tooth 6 for anchoring the base frame 2 at a medial location along the blade unit as will become clear from the description that follows. The frame edge portions 5 are connected together by bridging strips 7 and by end strips 8 that provide supports and attachment points for the blades 3. The blade structure 1 comprising the base frame 2 and the blades 3 mounted thereon is resiliently flexible. The base frame can be readily produced by stamping from a thin metal sheet or as a plastic molding and can have the metal blades 3 fixed securely thereto by spot welding or by adhesive at the bridging and end strips 7, 8.

The blade structure 1 is carried on a deformable supporting structure 14 mounted in a main frame 15. The main frame 15 has a pair of front and rear guide plates 18 held together and spaced apart by spacers 19. The deformable supporting structure 14 includes a symmetrically opposed pair of unitary suspension members 22 that are disposed adjacent the respective guide plates 18. Each suspension member comprises a series of upwardly directed support element 24 interlinked adjacent their lower ends by integral hinges 25 so that the free upper ends of the support elements are able to move towards and away from the upper ends of their adjacent elements and the suspension member is deformable from the generally straight configuration shown in FIGS. 1 to 7 to the concave configuration shown in FIGS. 8 and 9, or the convex configuration shown in FIGS. 10 and 11. At their upper ends the support elements 24 have upwardly directed faces defined by shoulders and slots 26 immediately above these shoulders defined by finger elements overlying the shoulders. The edge portions 5 of the base frame 2 are received slidably in these slots 26 with the middle two support elements 24 of each suspension member 22 confining a detent notch 27 into which the projecting tooth 6 of the base frame 2 engages to retain the blade structure 1 against longitudinal movement relative to the middle support elements. Thus, as the blade structure 1 and the suspension members 22 flex concavely or convexly along their length the support elements 24 are able to slide relative to the base frame 2, while the engagement between the middle support elements 24 and the teeth 6 retains the blade structure against unwanted movements relative to the supporting structure. Integral with support elements 24 disposed towards the ends of each suspension member 22 are bosses 28, which are attached to the lower ends of the support elements, and pins 42 are inserted through the aligned bosses 28 of the two suspensions members 22.

Figure 8:
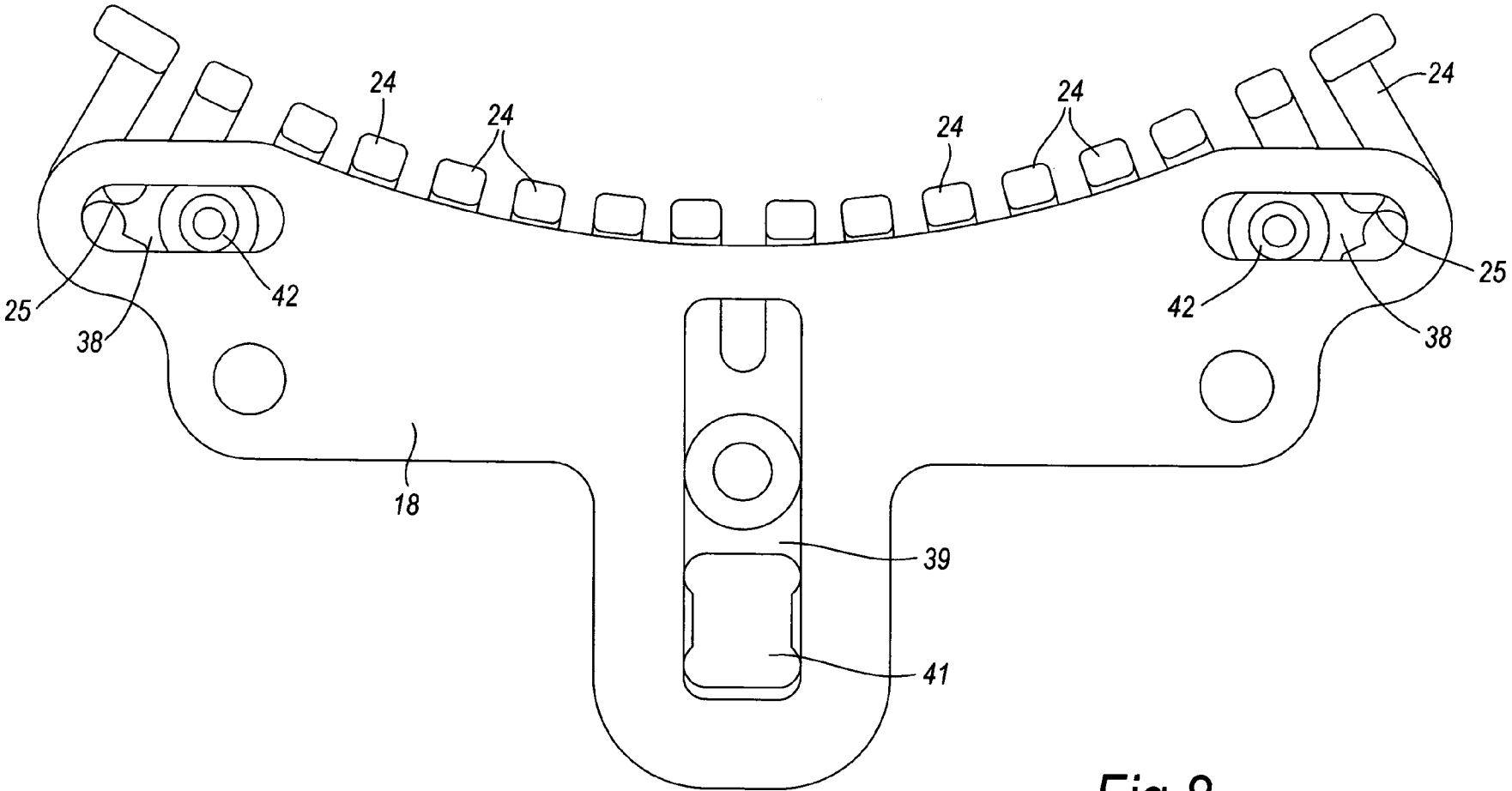
FIGS. 8 and 9 are a front elevation and an isometric view, respectively, showing the supporting structure of the blade unit shown in FIG. 1 deformed into a concave shape.
Figure 9:
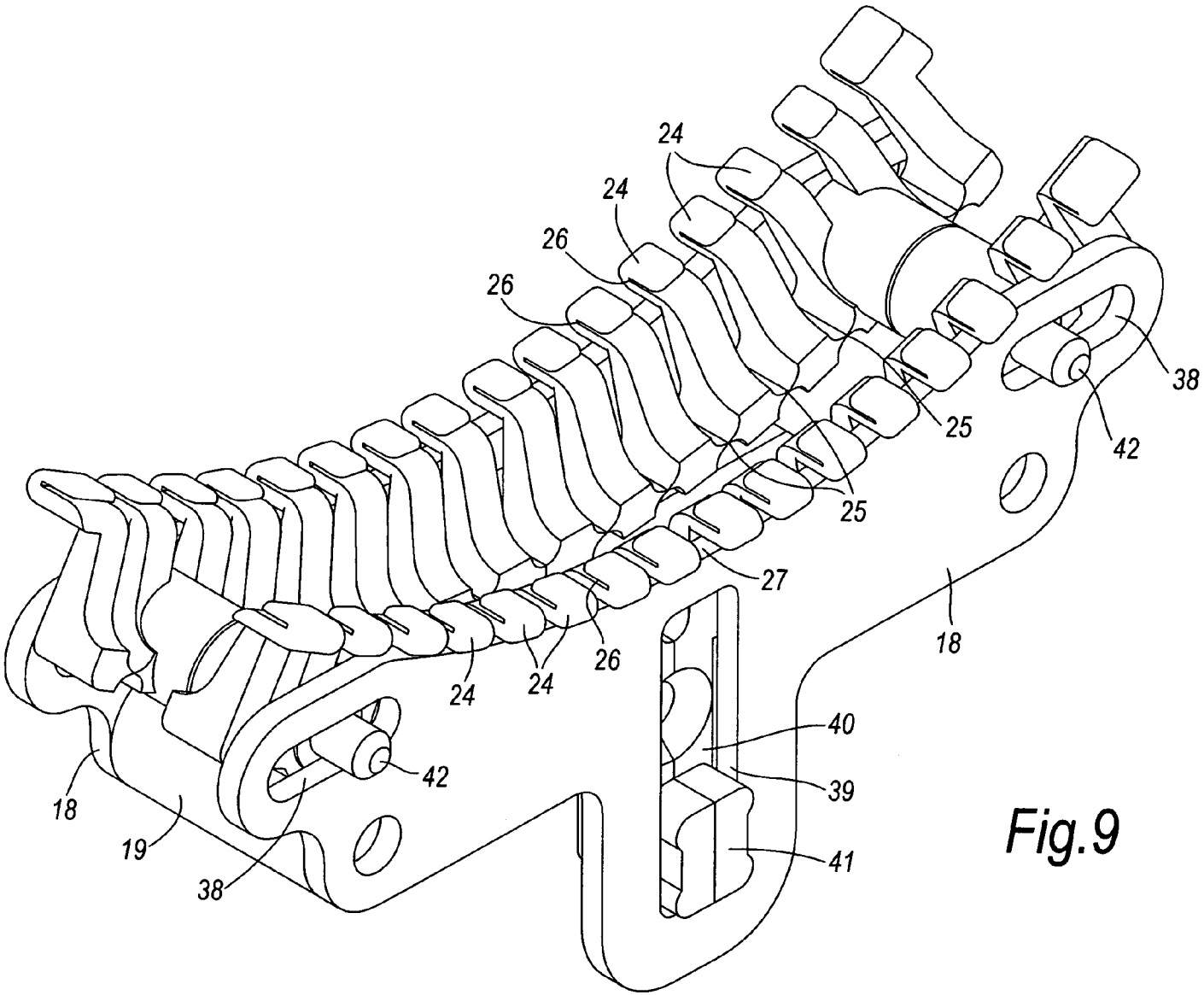
Figure 10:
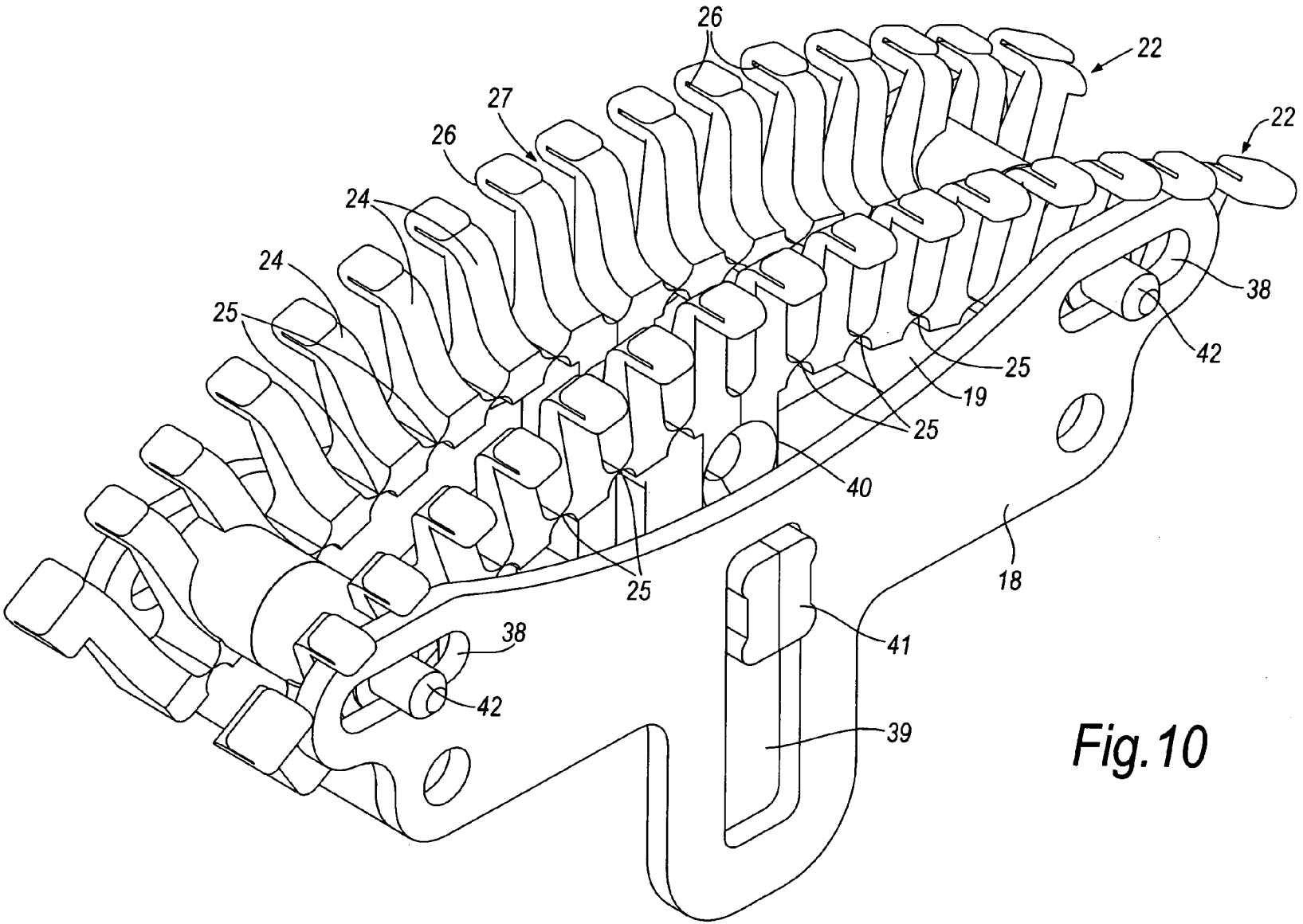
FIGS. 10 and 11 are a front elevation and an isometric view respectively showing the supporting structure of the blade unit shown in FIG. 1 deformed into a convex shape.
Figure 11:
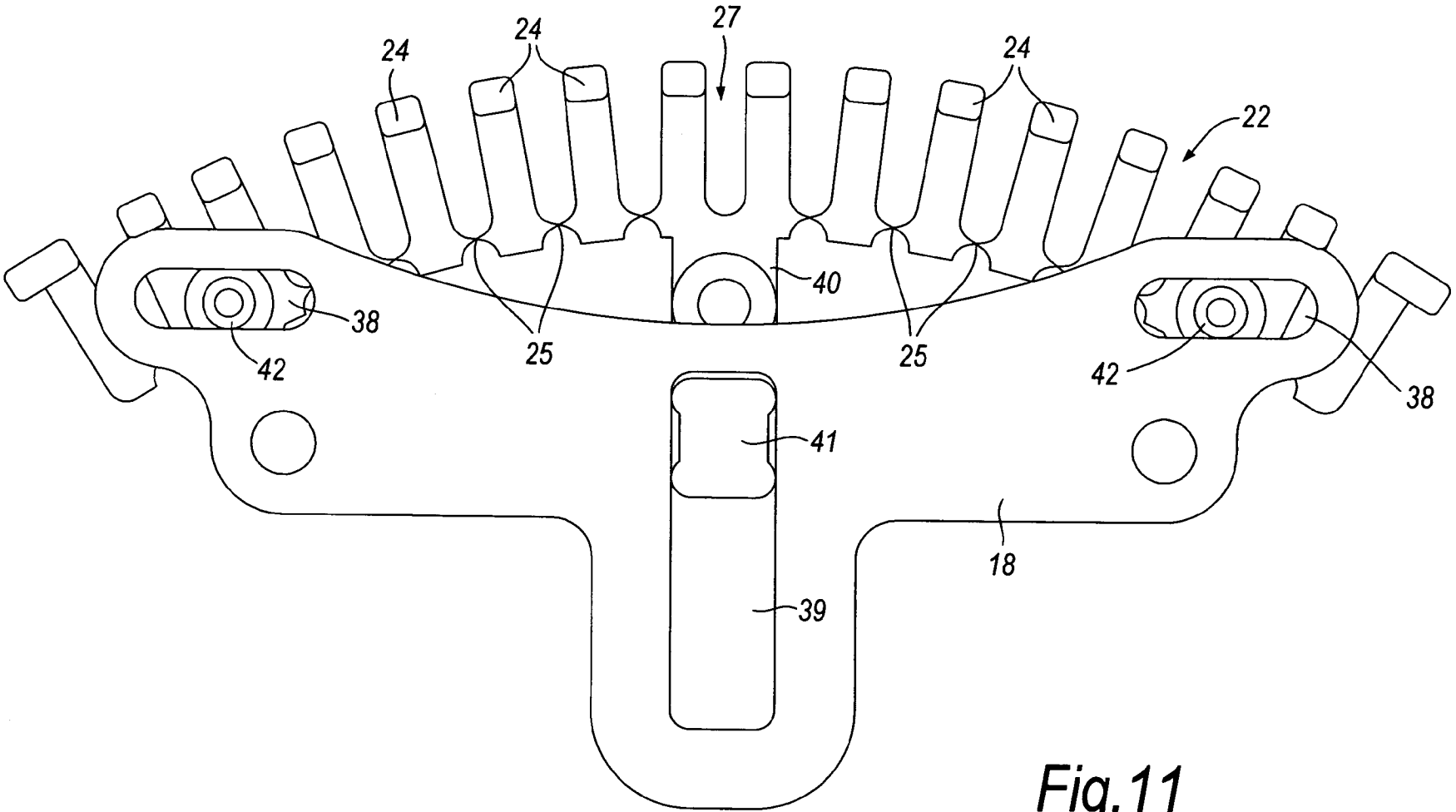
Figure 12:
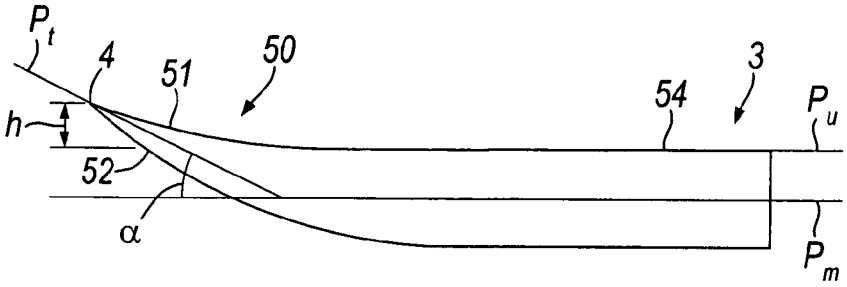
FIG. 12 is a cross-section through one of the blades of the blade unit illustrated in FIG. 1.

The deformation of the suspension members 22 under forces imposed on the blade structure 1 is controlled by the guide plates 18 each of which has a pair of longitudinally aligned guide slots 38 and a further linear guide slot 39 that extends in a direction perpendicular to the longitudinally aligned slots 38. The central support elements 24 of each suspension member 22 are extended downwardly by leg 40 that is located alongside the guide slot 39 and has a projecting slide block 41 slidably engaged in the slot 39 so that the central support elements 24 are guided for movement in the direction of the slot 39. Projecting ends of the pins 42 engage slidably in the guide slots 38. The arrangement of the guide slots 28, 39 and pins 41, 42 ensures that the suspension members 22 and hence the blade structure 1 supported by them always adopt a smooth uniform curvature when displaced from the normal straight configuration due to a force imposed against the blade structure. A force directed at the central region of the blade structure e.g. when the blade structure is pressed against a convex skin contour will result in the blade structure and the deformable support structure 14 adopting a concave form, e.g. as depicted in FIGS. 8 and 9, whereas a force directed at the ends of the blade structure, as may occur when it is pressed against a concave skin contour will cause the blade structure and its supporting structure 14 to assume a convex curvature as depicted in FIGS. 10 and 11.

In each of the support members 22 all of the support elements 24 in the series may be linked by hinged connections 25 to the immediately adjacent support elements on either side. However, in the construction as shown in the drawings each of the two bosses 28 and the leg 40, by means of which the suspension member 22 is coupled to the guide arrangement for controlling the deformation of the suspension member between concave and convex configurations, are connected firmly to two adjacent support elements 24 whereby these two elements always remain parallel to each other as the suspension member deforms. Because there is a large number of support elements that are positioned closely to one another having these pairs of adjacent elements which are not connected by hinges so that they do not move relative to one other does not impair the ability of the suspension member to deform and the blade structure supported thereby to adopt a smoothly concave or convex curvature. In an especially simple construction projections for engagement in the guide slots 38, 39 can be carried by, e.g. formed integrally with, respective support elements 24 of the suspension member. In addition whereas the detent which anchors the blade structure against longitudinal movement at the centre of the assembly is formed by a single tooth 6 which engages in the gap between two support elements other forms of detent can also be contemplated, such as the blade structure having two teeth 6 spaced apart to define a notch in which one of the support elements is engaged. Furthermore, a satisfactory detent can be provided by staked, pinned or other form of localized fixing between the blade structure and a support element of the supporting structure 14.

Figure 13A:
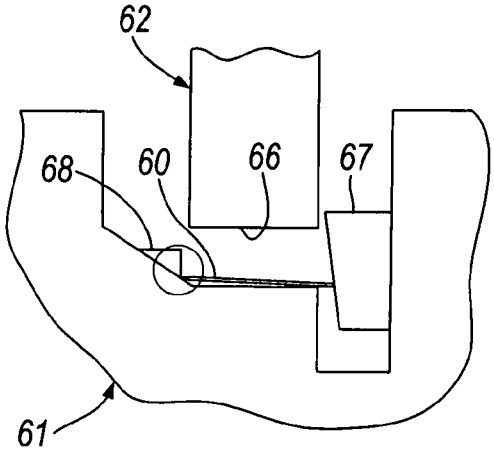
FIGS. 13A, 14A, 15A are schematic illustrations showing successive stages in shaping the blade of FIG. 12 by a pressing operation.
Figure 13B:
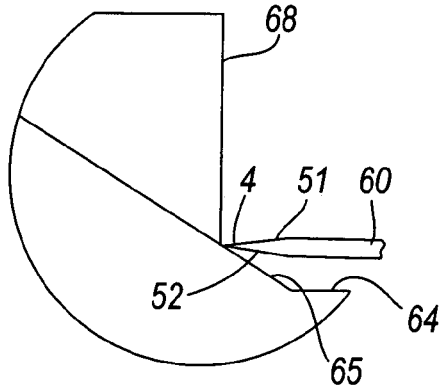
FIGS. 13B, 14B, 15B are enlarged scale views of the circled areas of FIGS. 13A, 14A, 15A, respectively.
Figure 14A:
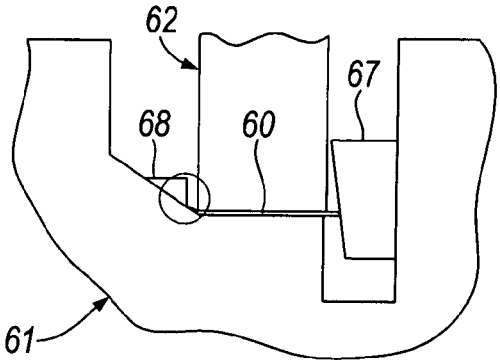
Figure 14B:
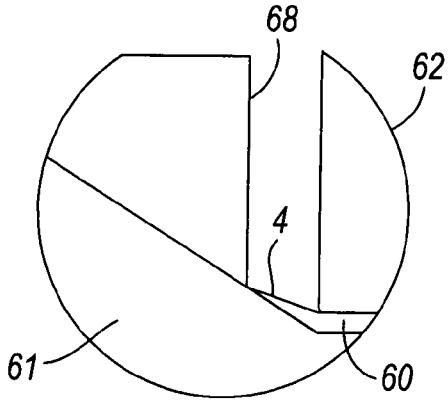
Figure 15A:
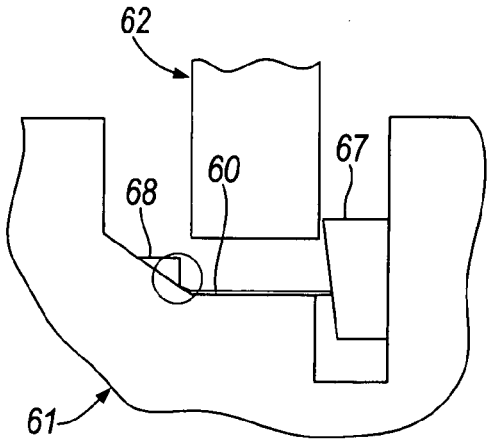
Figure 15B:
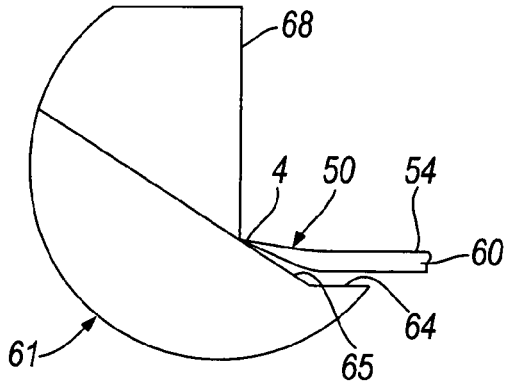

The blade structure 1 comprises the base frame 2 and the plurality of blades 3. Maximum flexibility of the blade structure is ensured by the blades and flat strips that make up the base frame being coplanar in the normal, undeformed condition of the blade structure 1 and its supporting structure. Each of the blades 3 comprises an elongate blade element with a forward edge section 50 (FIG. 12) forming the sharp cutting edge 4, the tip of this edge being confined between opposed surface portions 51, 52 referred to hereinafter as facets which taper towards the tip, and a substantially planar blade section 54 extending rearwardly from the forward edge section 50. The forward edge section 50 is canted upwardly towards the tip of the cutting edge 4 so that a plane $P_t$ bisecting the angle between the facets 51, 52 at the tip of the cutting edge is inclined at an angle $\alpha$ of around 20° to 25° to the plane $P_m$ of the planar section 54. The tip of the cutting edge 4 is can be positioned above the Plane Pu of the upper surface at the planar section at a height of up to 0.25 mm, preferably a height in the range of 0.05 to 0.15 mm. The inclination of the canted forward section 50 is obtained by bending a planar blade element blank 60, as illustrated in FIGS. 13A, 14A and 15A, by pressing the blade element blank 60 in a tooling assembly comprising a lower first member 61 and an upper second member 62. The lower tool member 61 defines a flat pressing surface 64 which is extended forwardly by a ramp surface 65. The upper tool member 62 has a flat pressing surface 66 which confronts the flat pressing surface 64 of the lower member 61, and the upper member 62 is moveable relative to the lower member 61 for pressing a blade element 60 between the flat pressing surfaces. The lower member 61 has a rear stop 67 for abutting the rear edge of a blade element blank 60 and a front stop 68 located on the ramp surface 65 for abutment with the tip of the blade edge. The stops 67, 68 may be adjustable to suit the width of the blade element blanks 60 to be pressed, and to adjust the position of the bend to be produced with respect to the tip of the blade edge 4, the rear stop 67 being adjustable vertically and having an inclined front face for this purpose.

An elongated planar blade element blank 60 with a finished cutting edge 4 along its forward edge is introduced between the upper and lower tool members 61, 62, and is brought to rest against the flat surface 64 of the lower member with its rear edge in contact with the rear stop 67 and the tip of the cutting edge 4 resting on the ramp surface 65 and against the front stop 68 (FIGS. 13A and B). The blank is therefore initially tilted at a small angle to the flat surfaces 64. The upper member 62 is then driven downwardly bringing its pressing surface 66 into contact with the blank 60 and causing the portion of the blank 60 between the surfaces 64, 66 to be pressed flat against the surface 64, and hence the forward edge section 50 of the blade to be pulled down against the ramp surface (FIGS. 14A and B). In one example the facets 51, 52 of the blade edge extend back from the edge tip by 0.3 mm, the blade thickness being 0.8 mm and, the front edge of the upper tool is aligned to contact the blade at a distance of 0.4 mm from the tip. When the upper member 62 is raised again, the bend produced in the blade blank 60 by the pressing operation recovers a little, but a permanent set in the blade blank 60 remains so that the forward edge section 50 is canted at the desired inclination with respect to the planar blade section 54 which extends rearwardly from it, and in a transition region between the forward section and planar section the lower surface has a convex curvature whereas the upper surface is non-convex, and more particularly concave. After completion of the blade shaping operation as described, a part of the blank including the canted forward edge section and a planar section several times wider, in the front to rear direction, than the canted forwarded edge section can be severed or snapped away from the blank to provide a flexible blade strip 3 of the desired width. The blades produced in this manner can then be used to produce blade structures as incorporated in the safety razor blade unit of FIGS. 1 to 11.

The blades 16 shaped and manufactured as described above, are characterized by a relatively high flexibility despite their being bent to raise the tip and incline the cutting edge 4 to obtain an effective blade tangent angle with the planar section 54 of the blade positioned parallel to the tangent plane. The flexibility can be conveniently expressed by the second moment of area of the blade cross section since razor blade materials currently used have Young's moduli which differ little from one another. The second moment of area I of a cross sectional area with respect to an axis X lying in the plane of the cross section is the sum of the products obtained by multiplying each element of area dA by the square of its distance y from the axis X. Thus:

It will be appreciated that the second moment of area is dependent on the shape and size of the cross section.

Figure 16A:
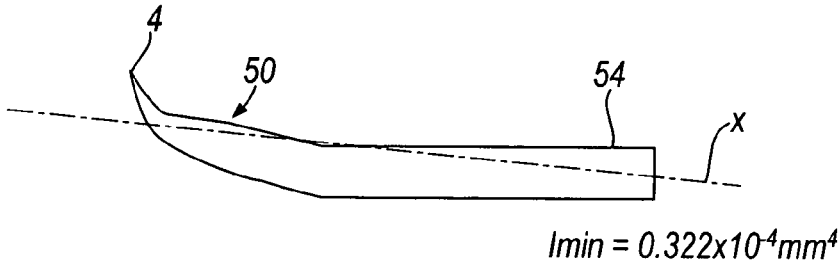
FIGS. 16A and 16B are cross sections through two blades indicating the axis with respect to which the second moment of area is at a minimum.
Figure 16B:
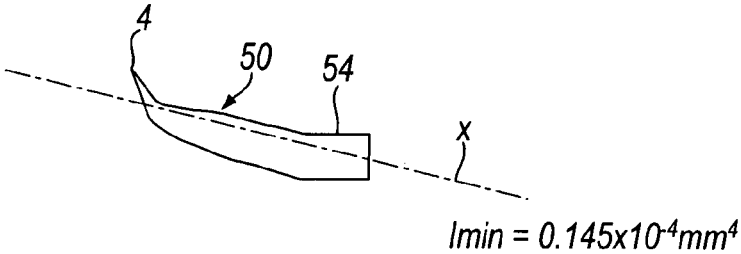
Figure 17:
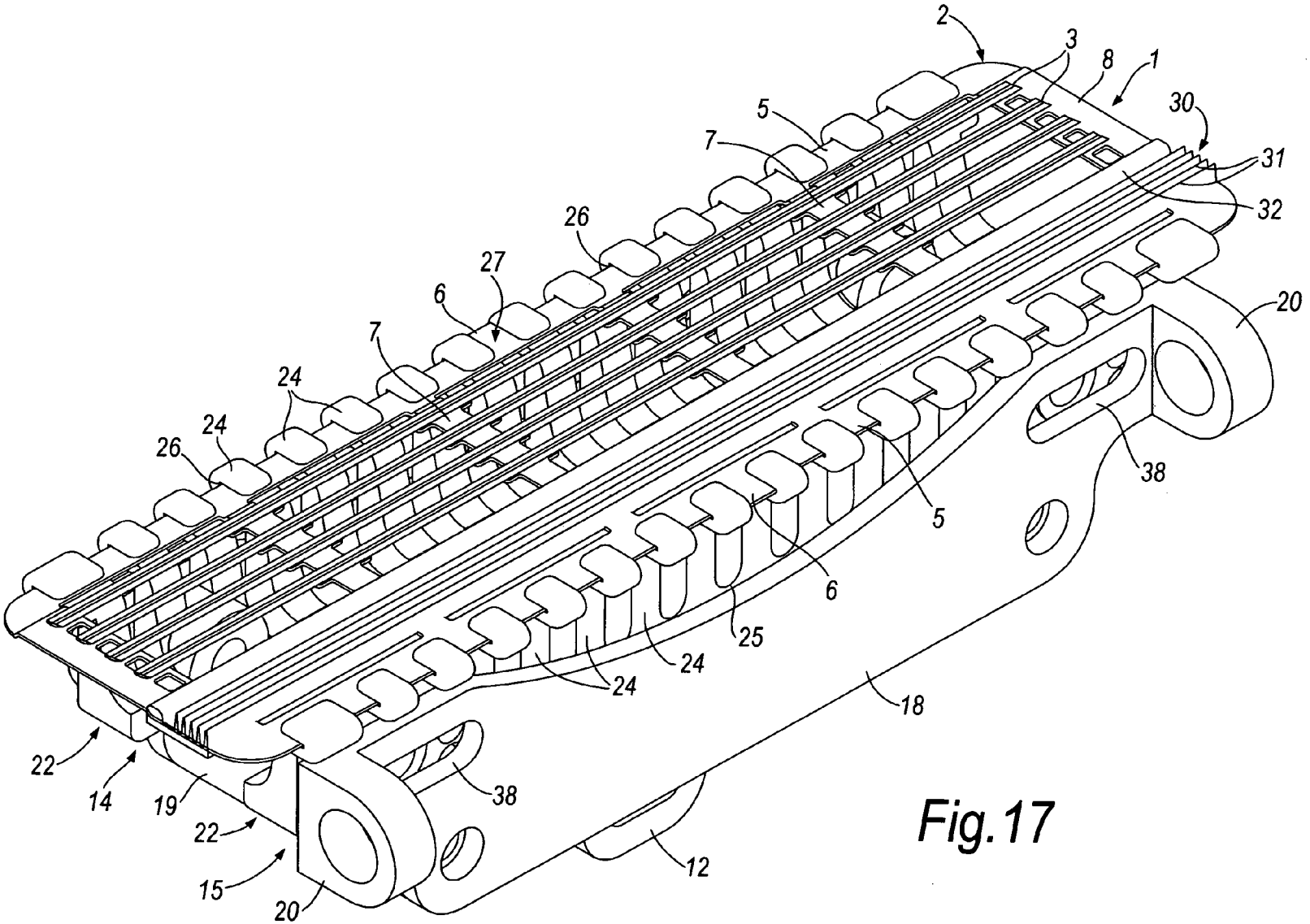
FIG. 17 is a front isometric view showing a second embodiment of a safety razor blade unit assembly according to the invention.
Figure 18:
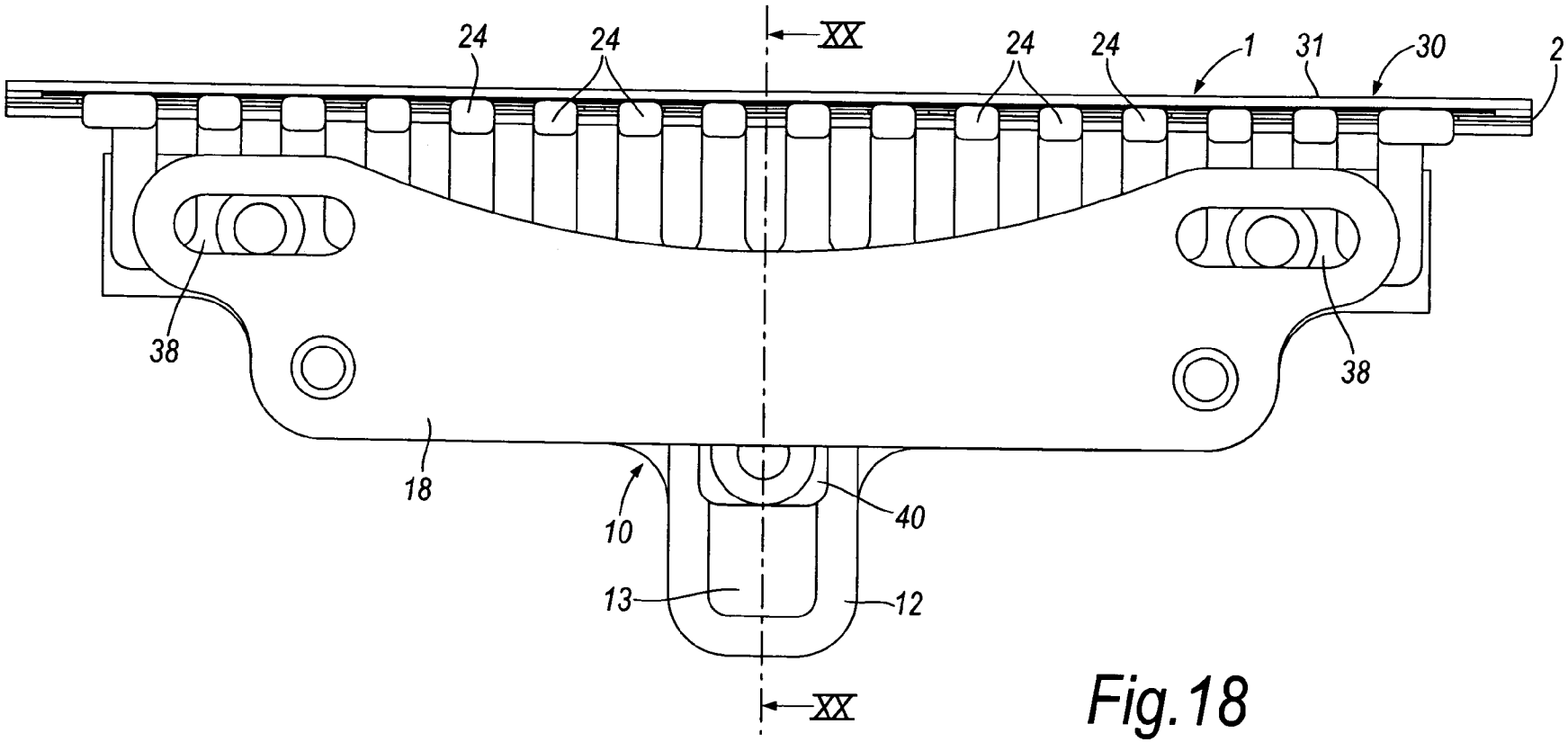
FIG. 18 is a front elevation of the blade unit shown in FIG. 17.
Figure 19:
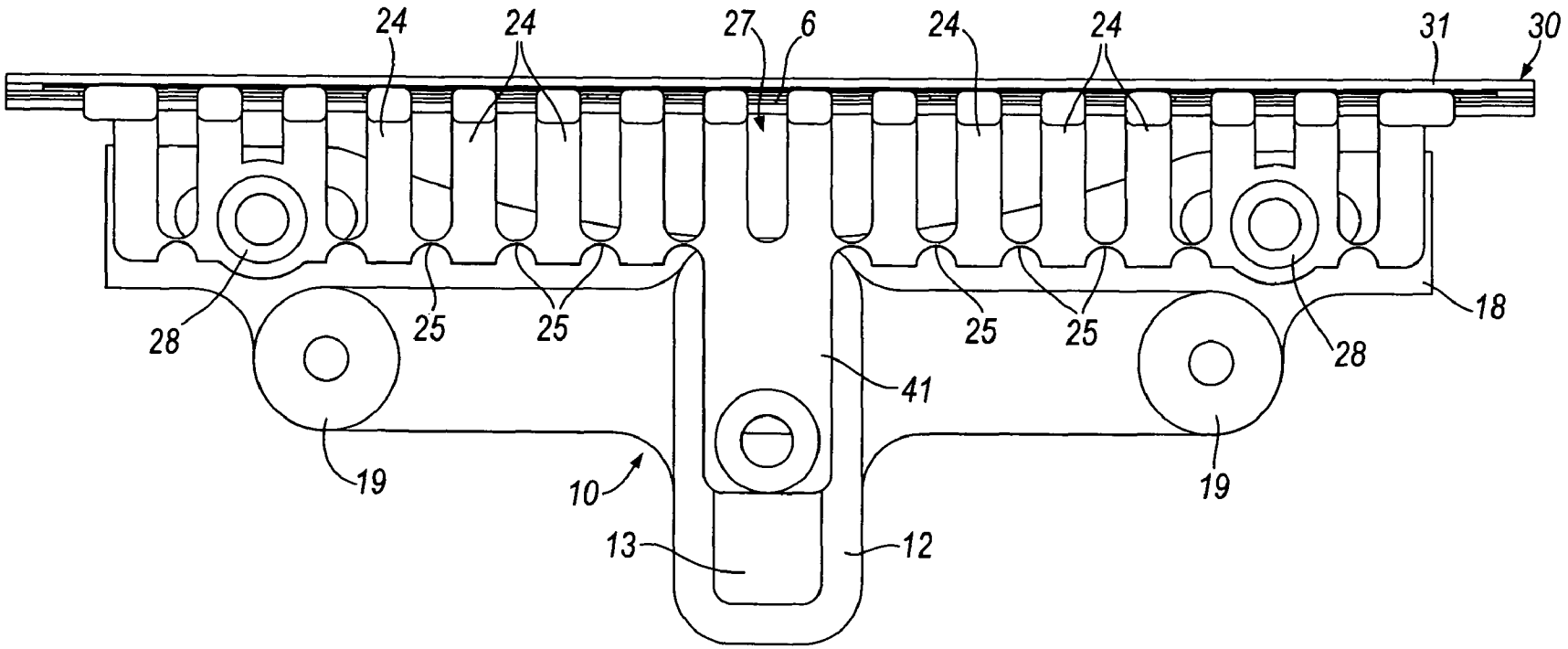
FIG. 19 is a front elevation of the blade unit shown in FIG. 17 with the front plate of the main frame removed.
Figure 20:
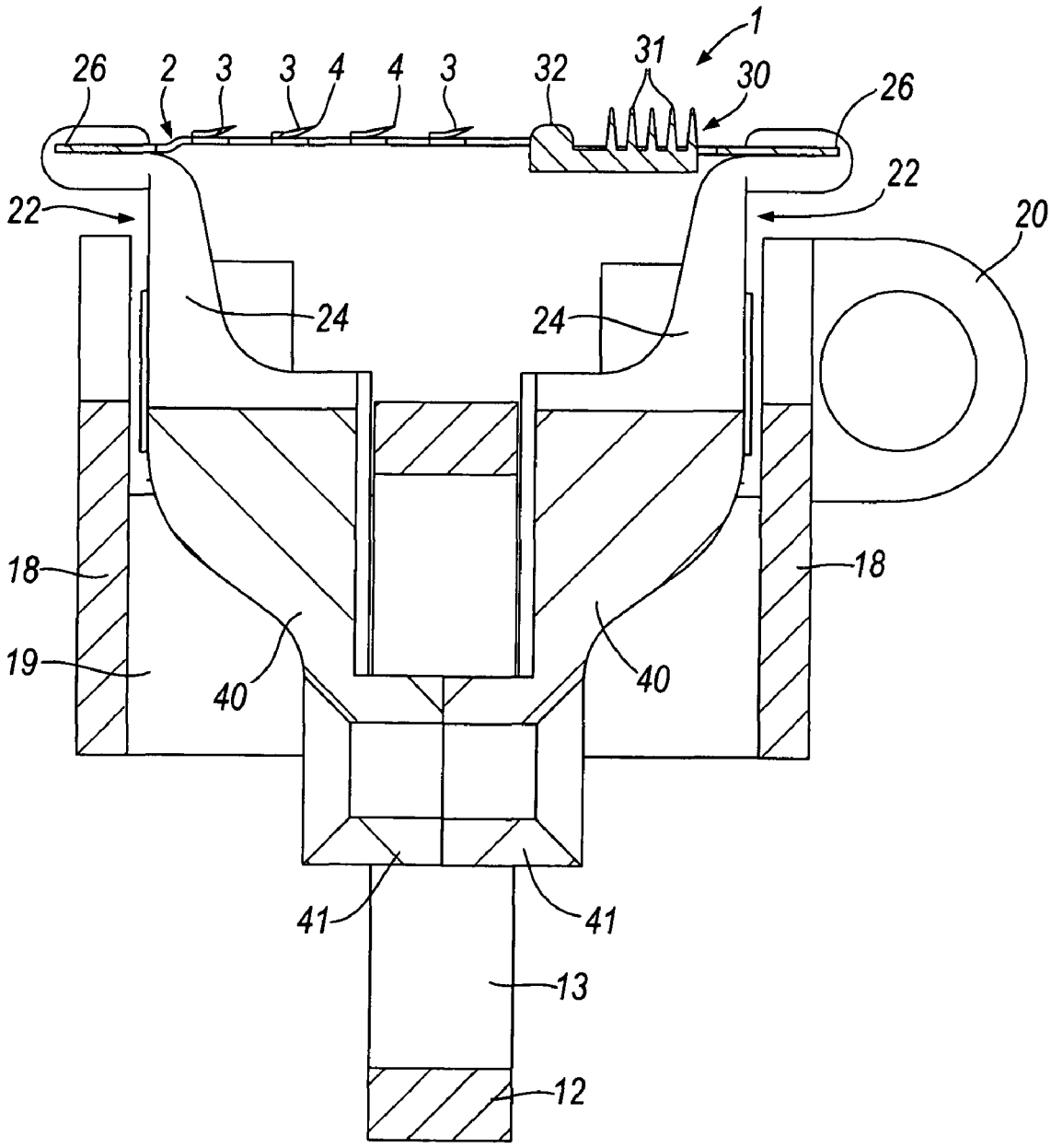
FIG. 20 is a cross section taken along the line XX-XX in FIG. 18.
Figure 21:
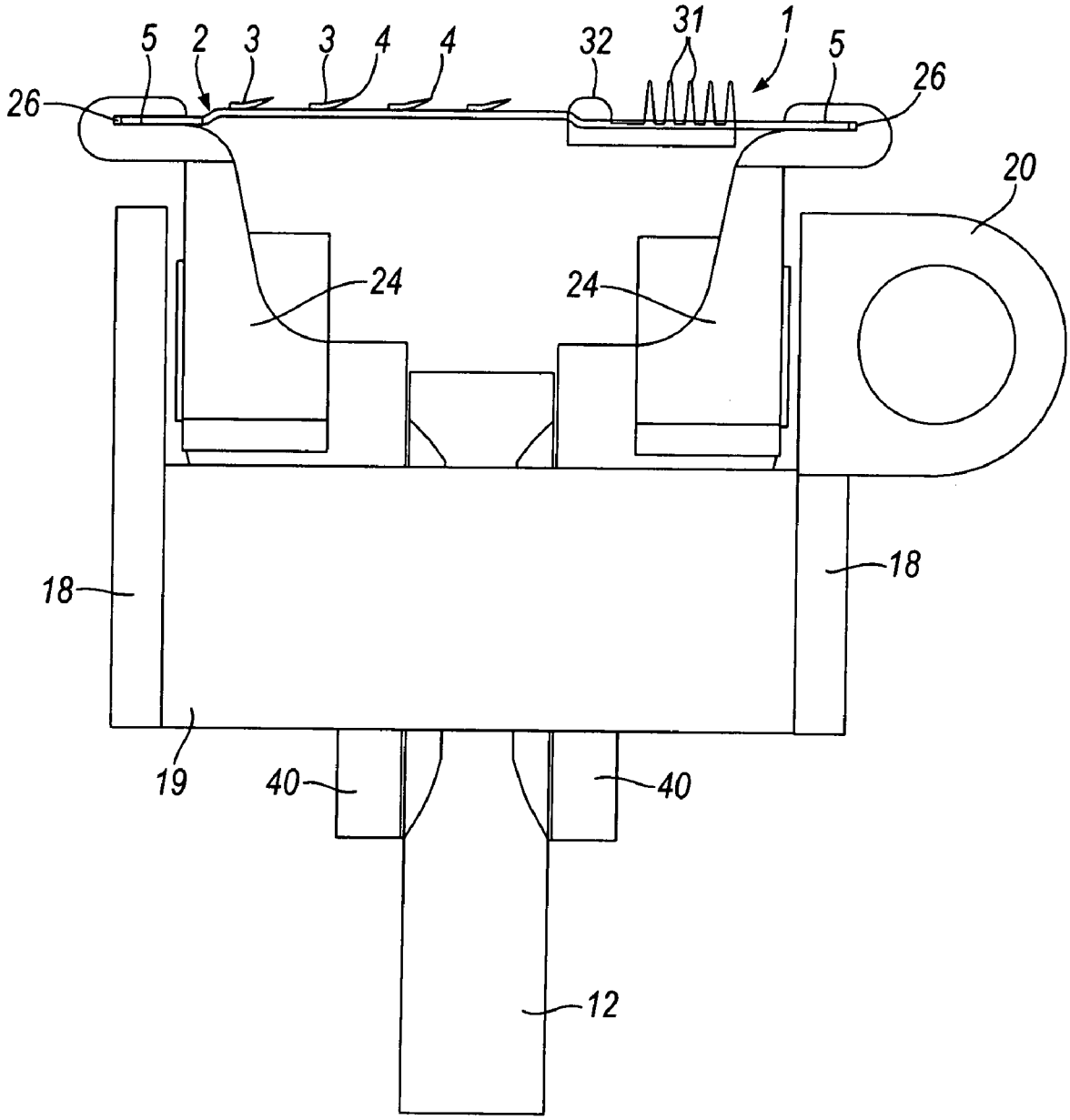
FIG. 21 is an end elevation of the blade unit shown in FIG. 17.

The minimum second moment area is the second moment of area measured with respect to that axis X which results in the smallest value for the second moment of area $I_{min}$. Illustrated in FIGS. 16A and 16B are the cross sections, taken in planes perpendicular to the lengths of the cutting edges, of two blades 3. The blade 3 of FIG. 16A is 0.08 mm thick and 0.80 mm wide with the planar section 54 being 0.40 mm wide, and its minimum second moment of area $I_{min}$ with respect to the axis X is $0.322\times10^{-4}$ mm$^4$. The blade of FIG. 16B has a thickness of 0.08 mm and a width of 0.80 mm with the planar section 54 being 0.10 mm wide, and in this case the minimum second moment of area is $I_{min}$ $0.145\times10^{-4}$ mm$^4$. The blades 3 can be positioned in the blade structure 2 with the mid planes of their planar sections 54 substantially parallel to a plane tangential to guard and cap surfaces of the blade structure, and the second moments of area I measured about the axis parallel to these mid planes and intersecting the centers of area for the blades shown in FIGS. 16A and 16B have values of $0.443\times10^{-4}$ mm$^4$, and $0.26310^{-4}$ mm$^4$, respectively. To achieve a desired level of blade flexibility in an assembled blade unit, it is also preferred that the second moment of area with respect to an axis passing through the centre of area and parallel to the mid plane of the planar section 54 is not greater than $1.0\times10^{-4}$ mm$^4$, and more especially not greater than $0.5\times10^{-4}$ mm$^4$. If the blade 3 has a cross section which is constant along its length the I values given above will apply at every position along the length. However, there may be short blade sections where the I values are different, because the cross section is different, and the desired flexibility can be assured by the blade having a form such that the specified I values apply along at least most of the length of the blade.

Although described above in connection with shaping a blade having edge facets which, prior to bending of the blade, are symmetrical with respect to the centre plane of the blade, this is not essential and the blade edge could have an initial asymmetrical form including a so-called chisel edge in which the tip lies at the top surface plane of the blade.

Further information and details regarding the blades 3 and their manufacture can be gathered from U.S. Pat. No. 6,804,886 B, the contents of which are incorporated herein by reference.

Figure 22:
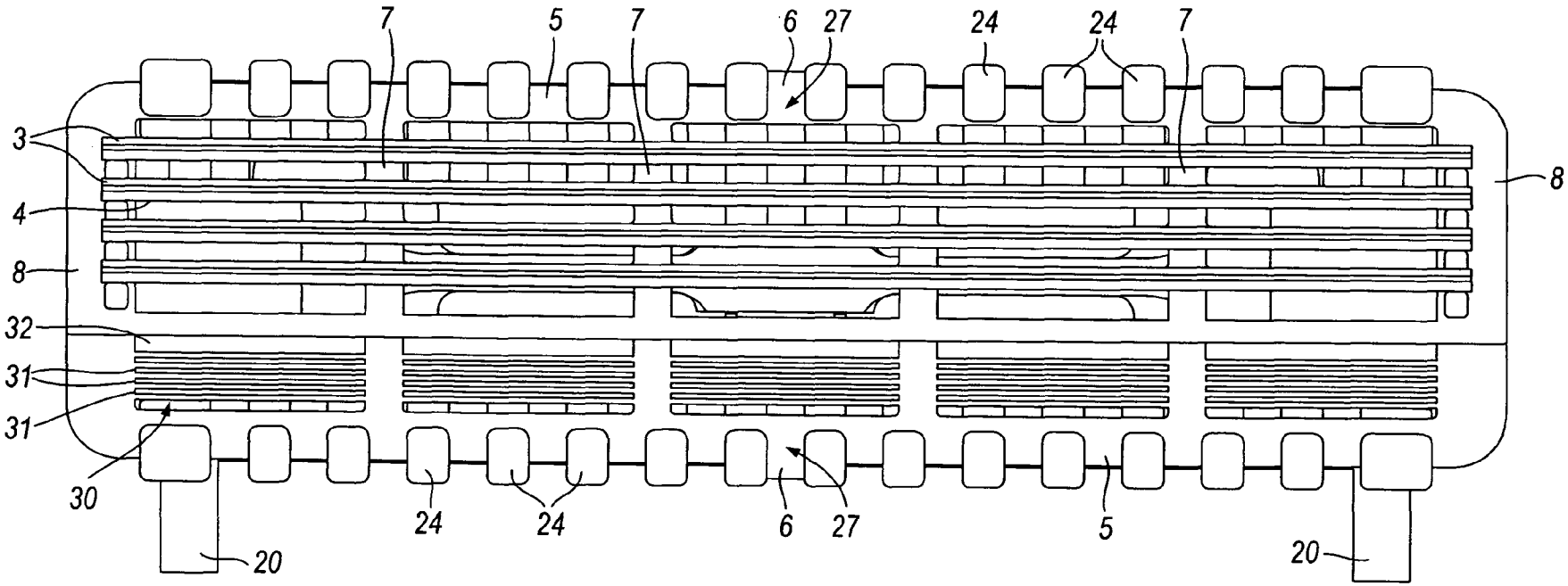
FIG. 22 is a top plan of blade unit shown in FIG. 17.
Figure 23:
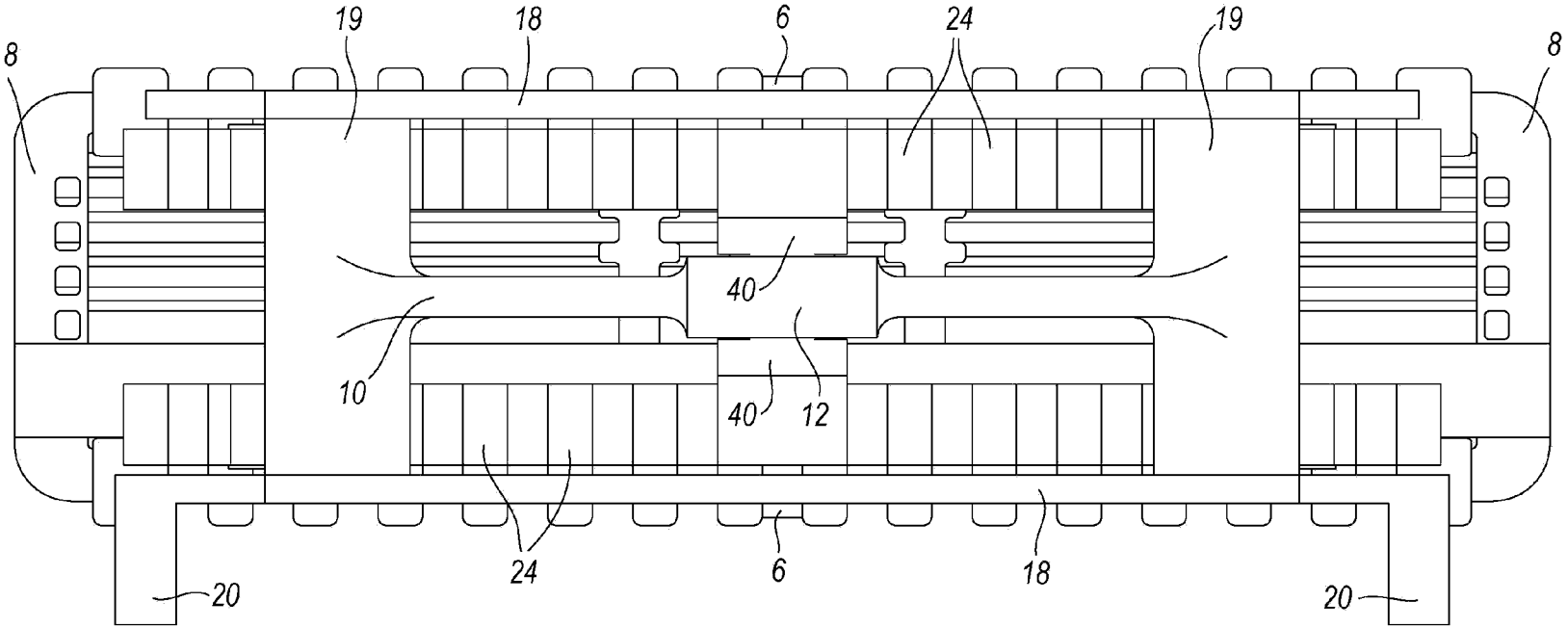
FIG. 23 is an underneath plan of the blade unit shown in FIG. 17.
Figure 24:
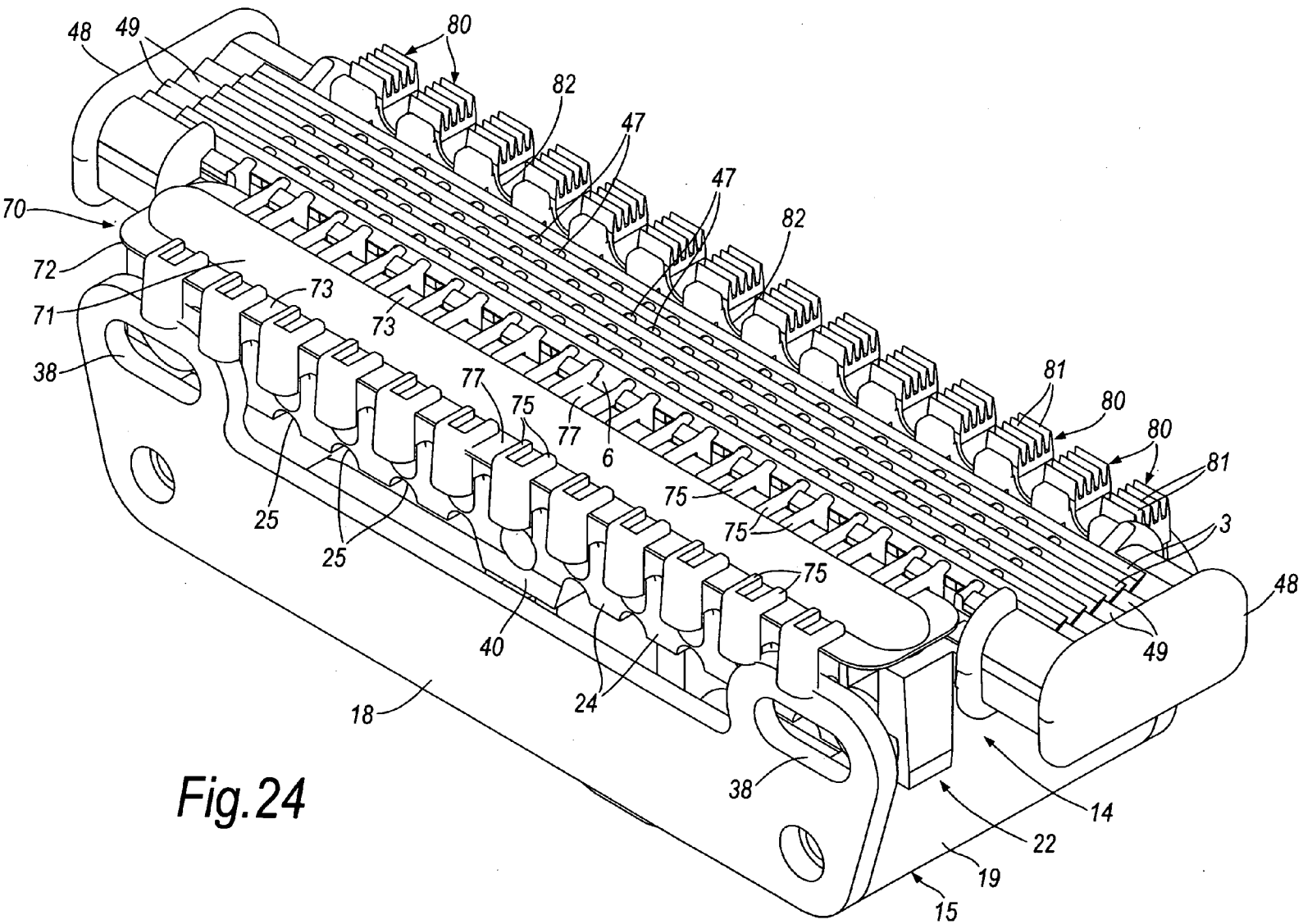
FIG. 24 is a rear isometric view of a third embodiment of a safety razor blade unit assembly according to the invention.
Figure 25:
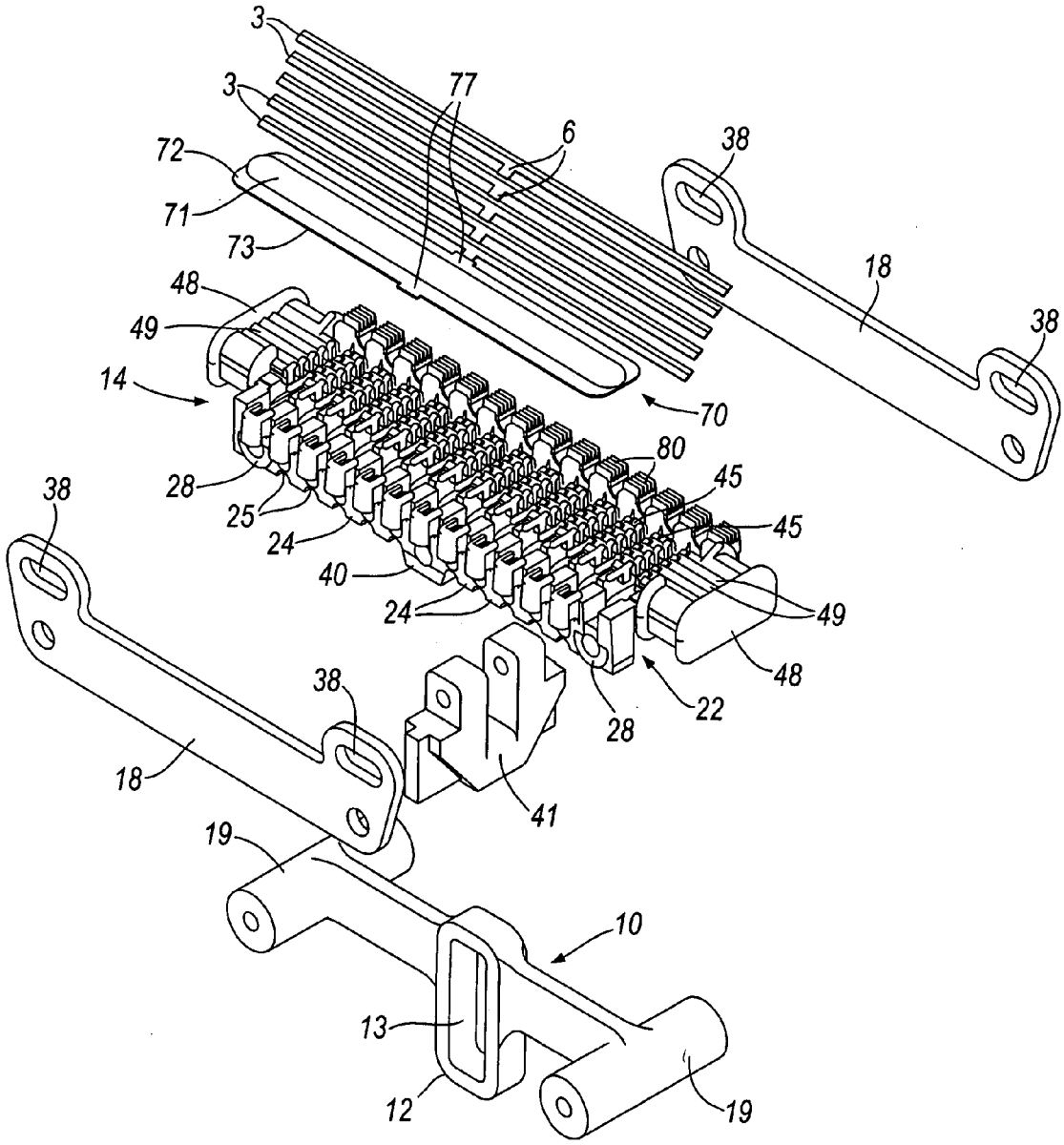
FIG. 25 is an exploded view illustrating the separate components of the blade unit of FIG. 24.
Figure 26:
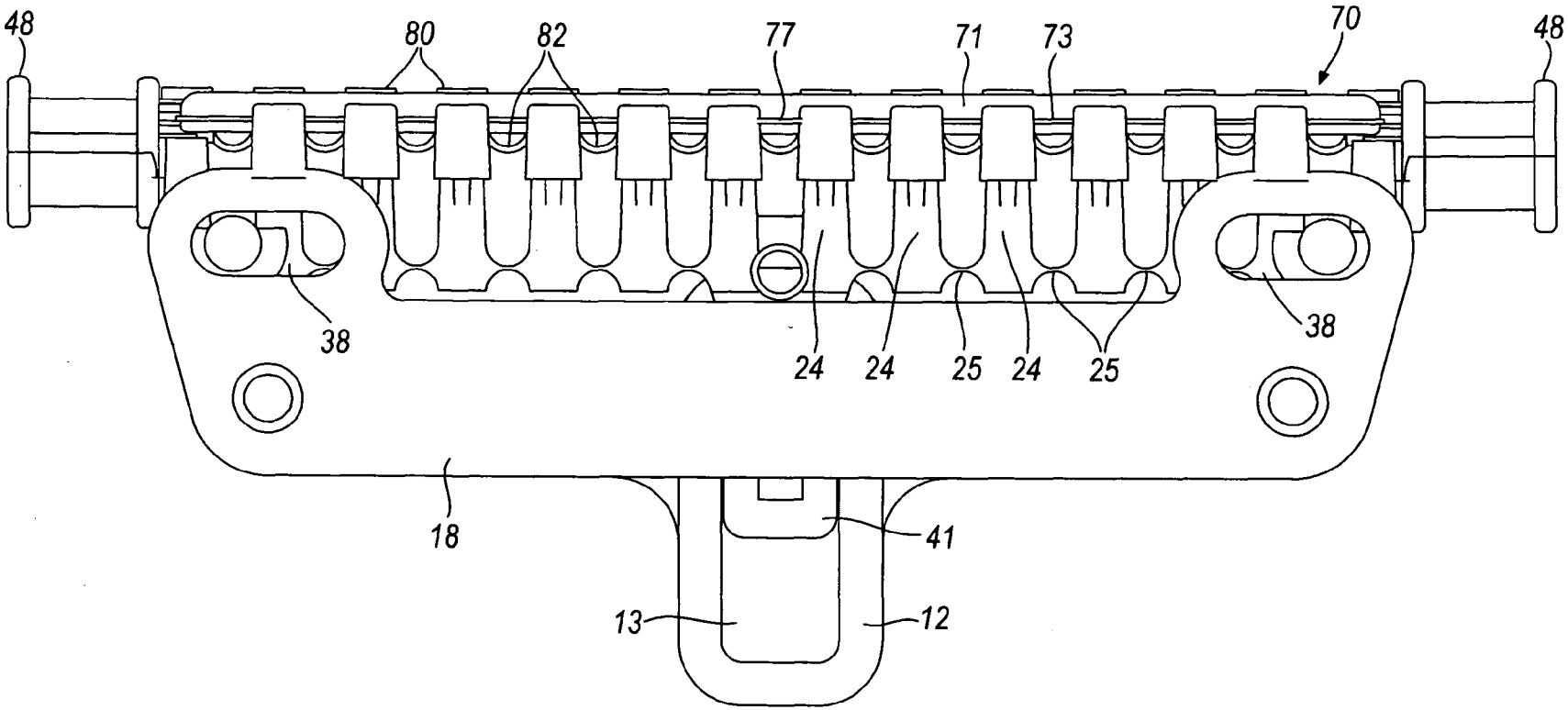
FIG. 26 is a rear elevation of the blade unit shown in FIG. 24.
Figure 27:
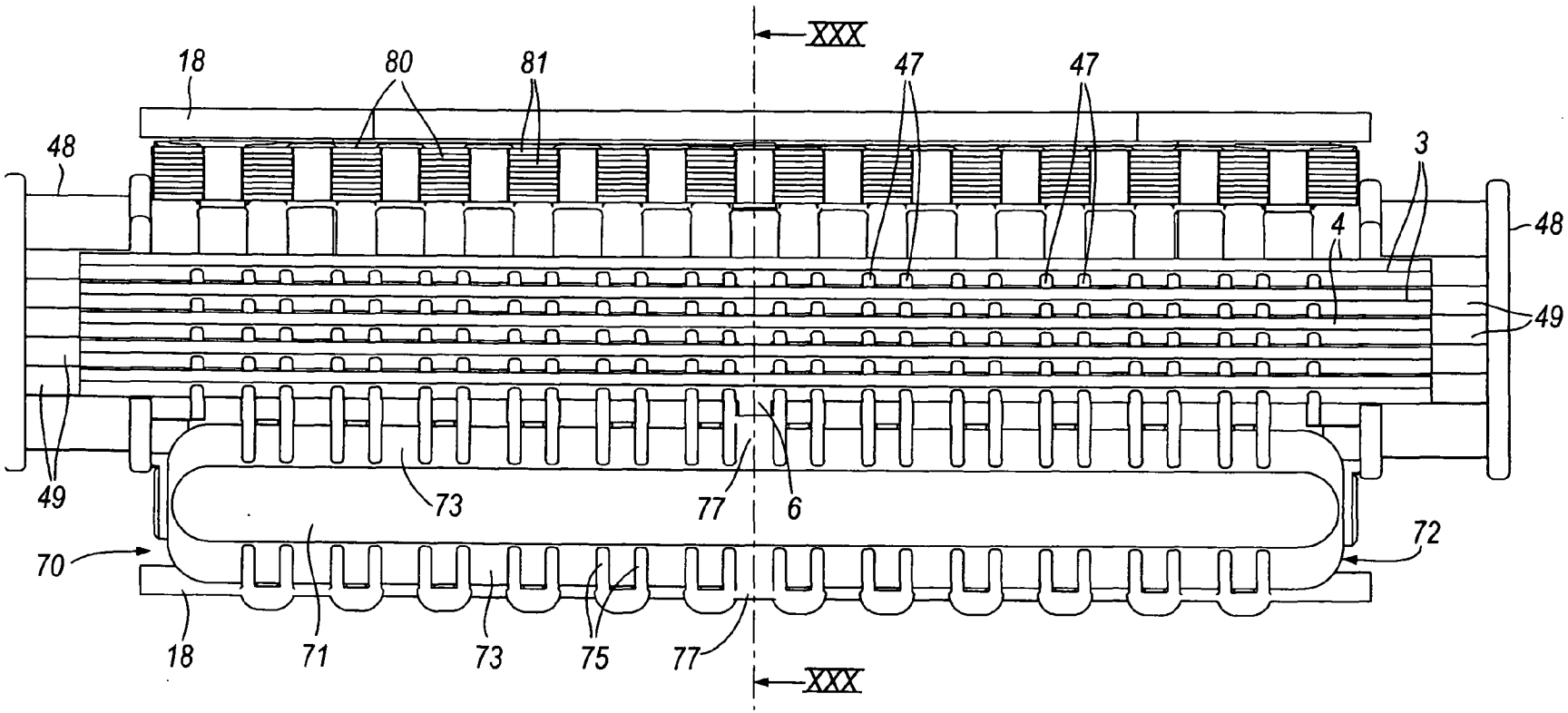
FIG. 27 is a top plan view of the blade unit of FIG. 24.
Figure 28:
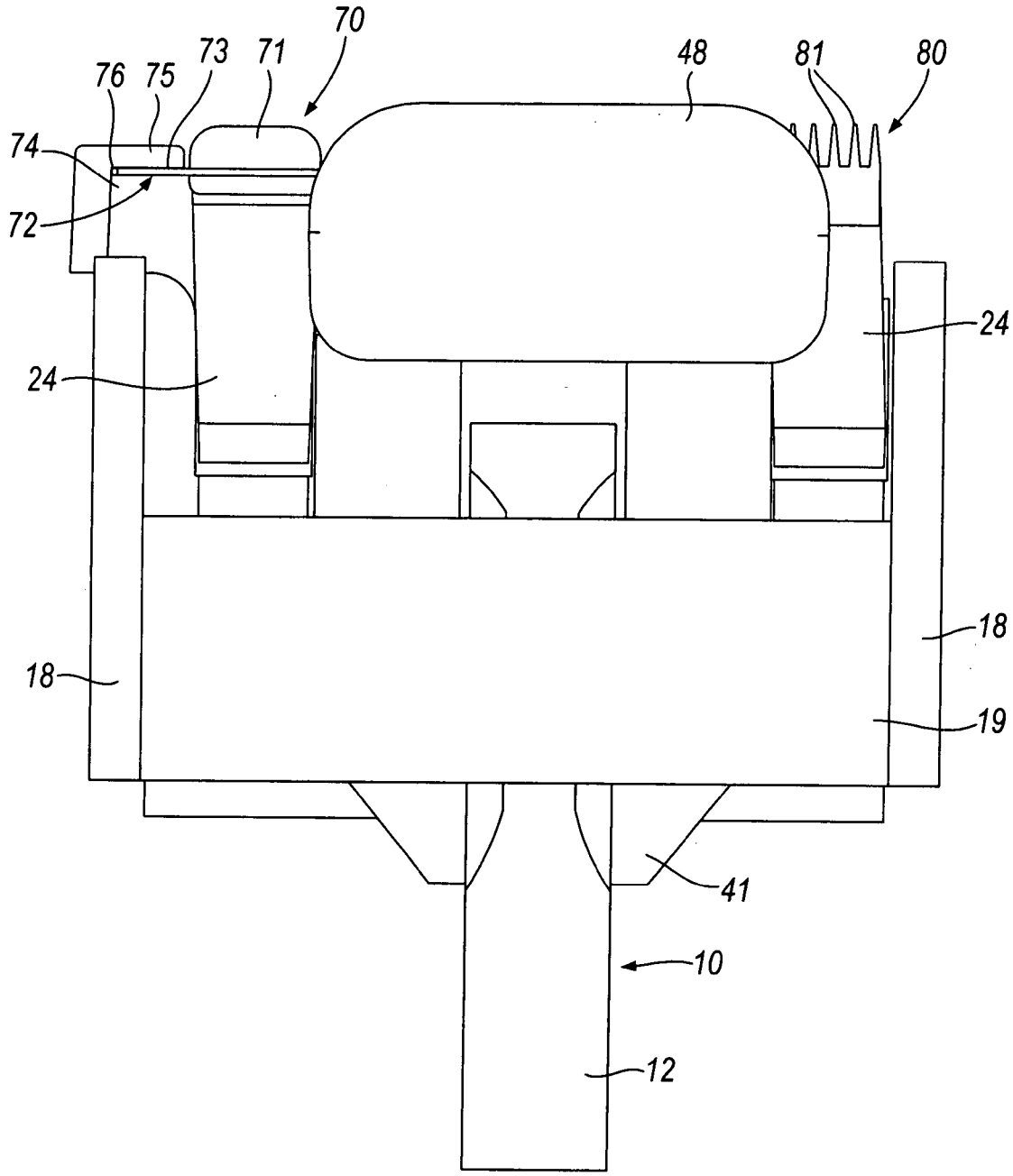
FIG. 28 is an end elevation of the blade unit of FIG. 24.
Figure 29:
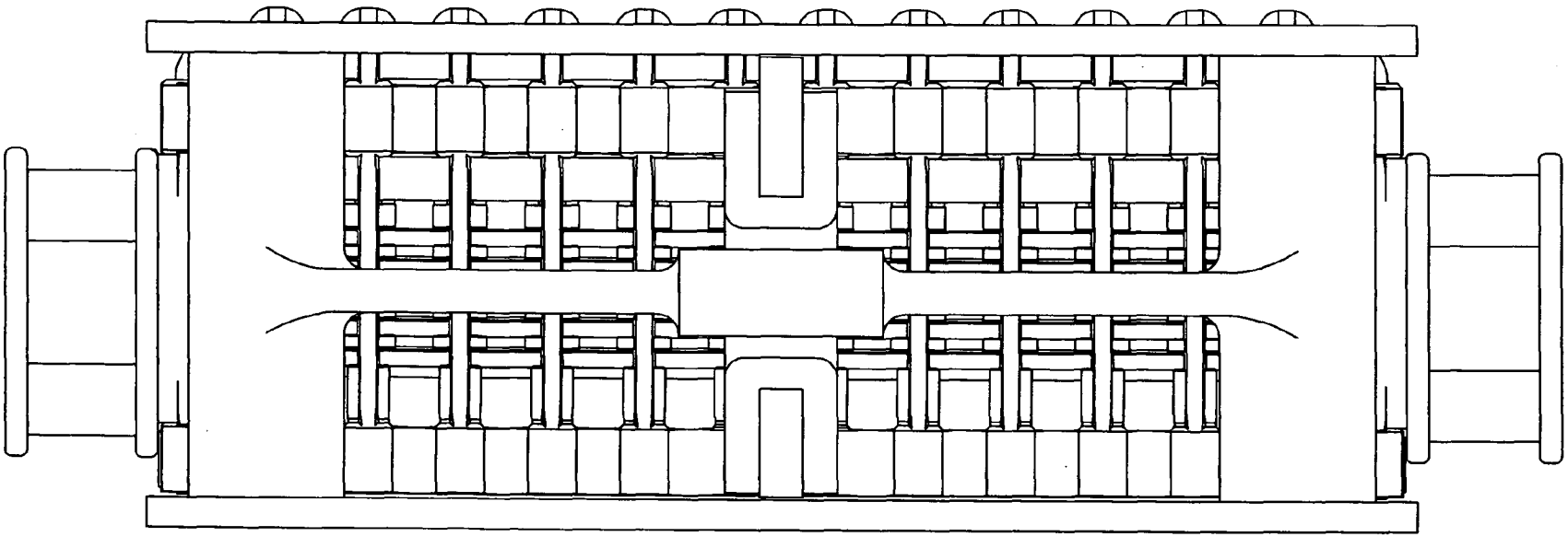
FIG. 29 is an underneath plan of the blade unit of FIG. 24.
Figure 30:
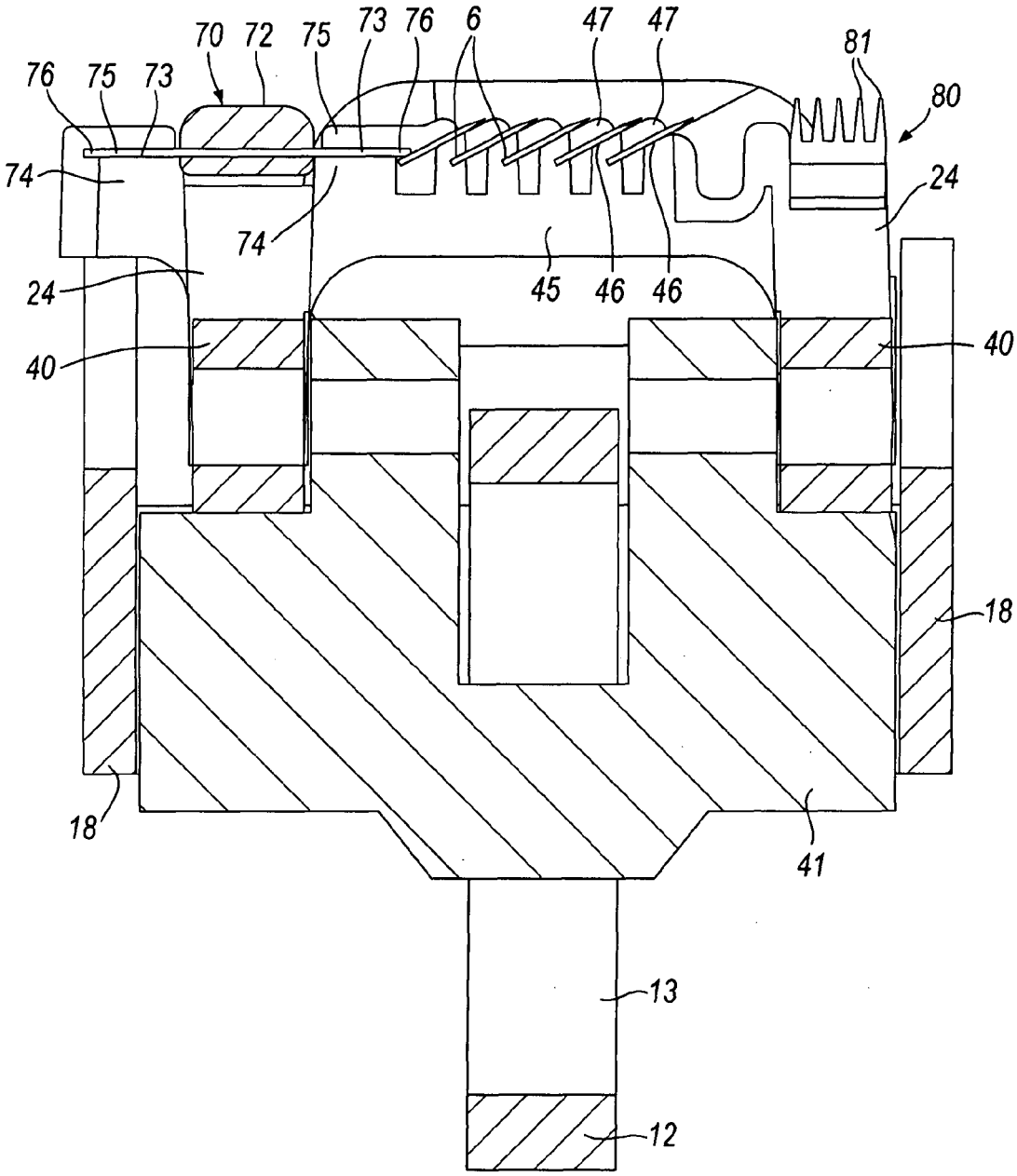
FIG. 30 is a section taken along the line XXX-XXX in FIG. 27.
Figure 31:
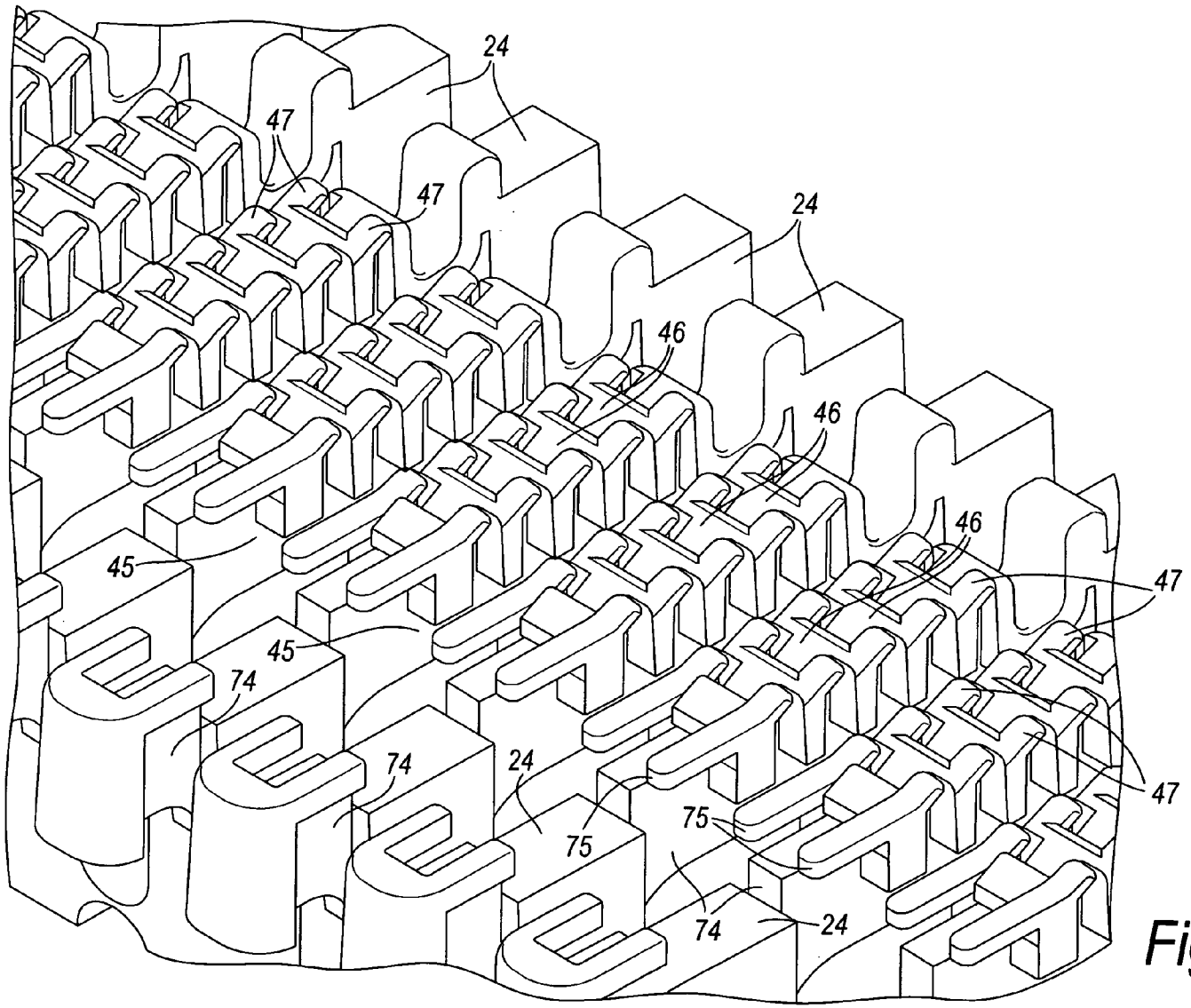
FIG. 31 is an enlarged scale view illustrating a part of the supporting structure of the blade unit of FIG. 24.
Figure 32:
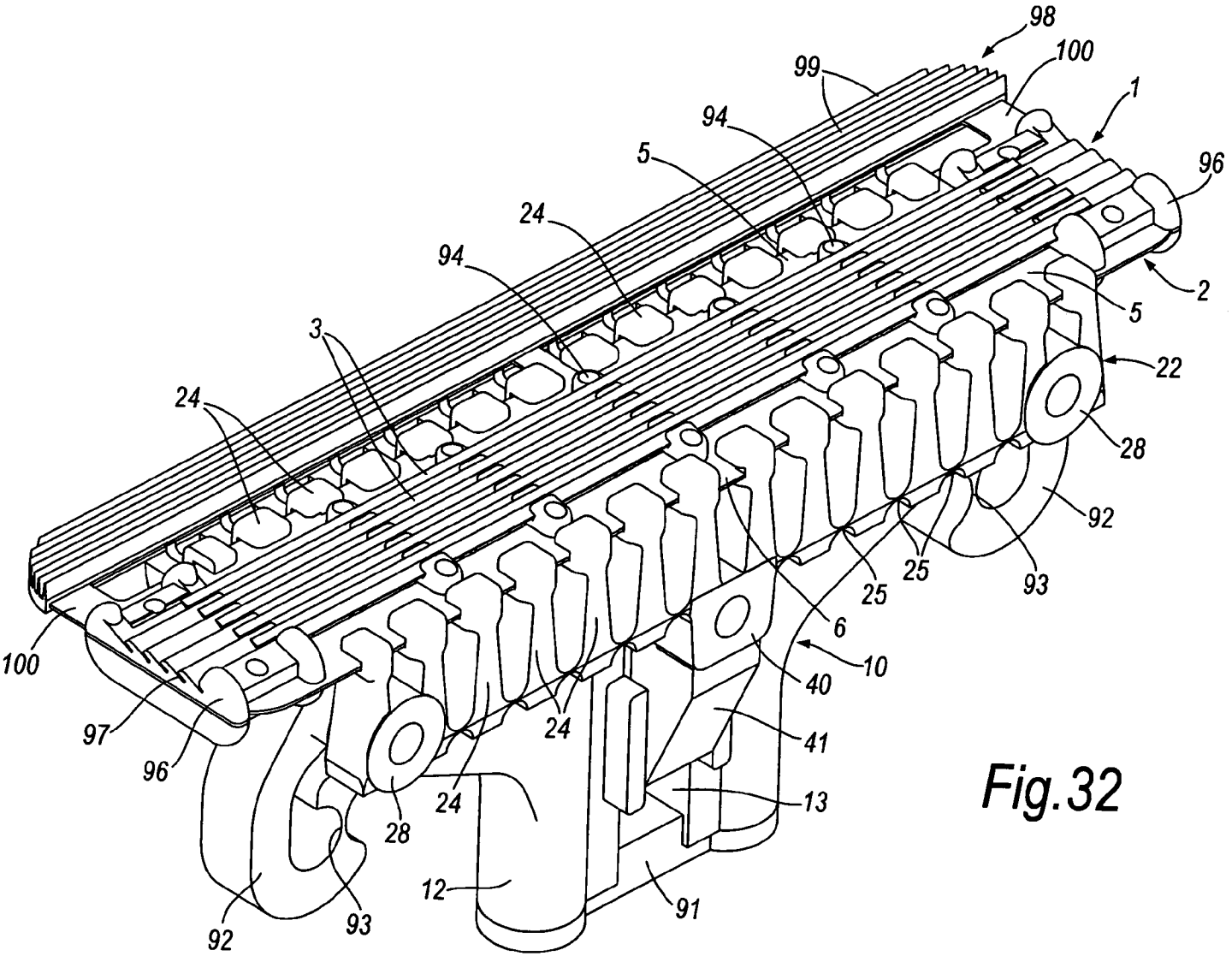
FIG. 32 is a rear isometric view of a fourth embodiment of a safety razor blade unit assembly constructed in accordance with the invention.
Figure 33:
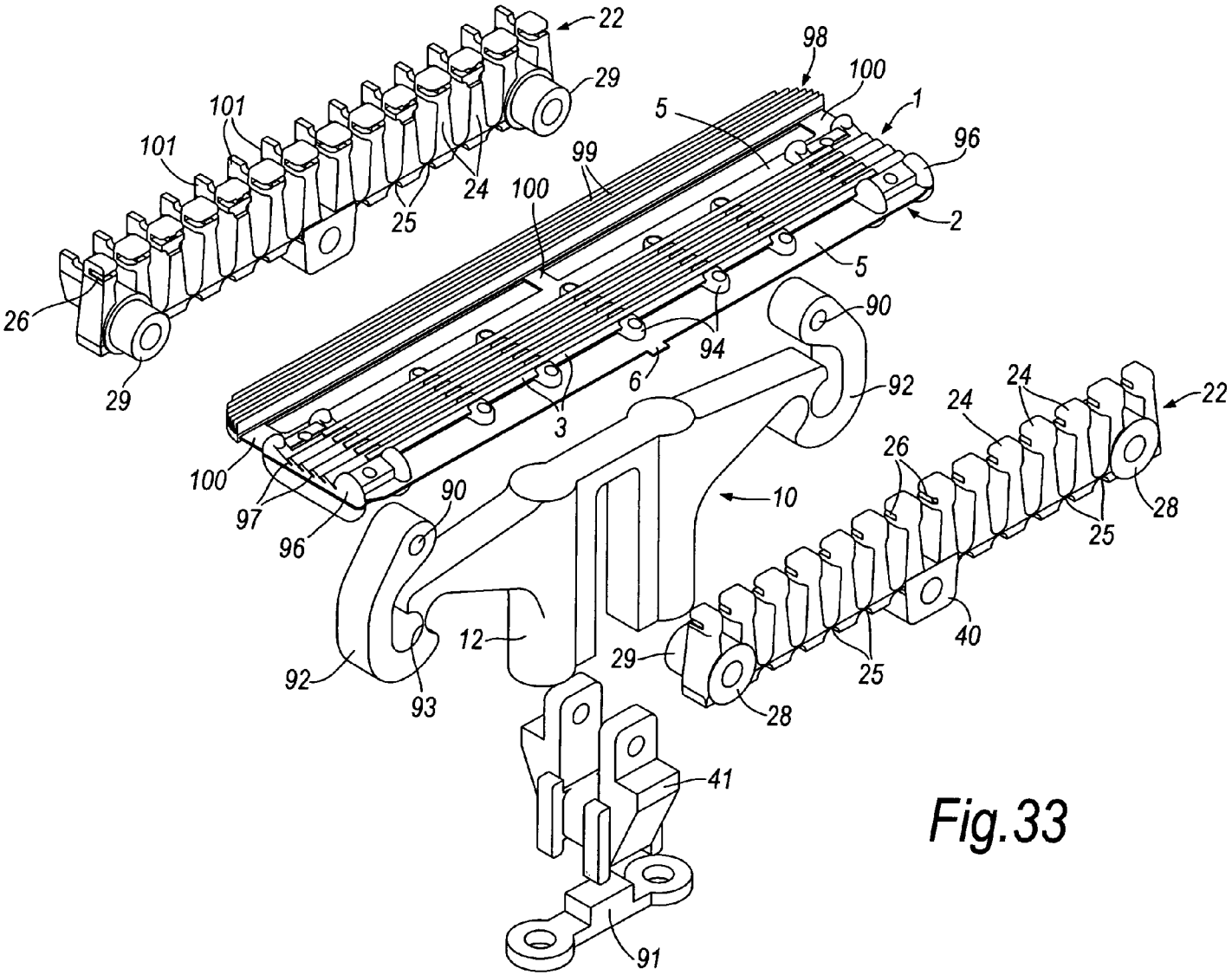
FIG. 33 is an exploded isometric view of showing the components of the blade unit of FIG. 32.
Figure 34:
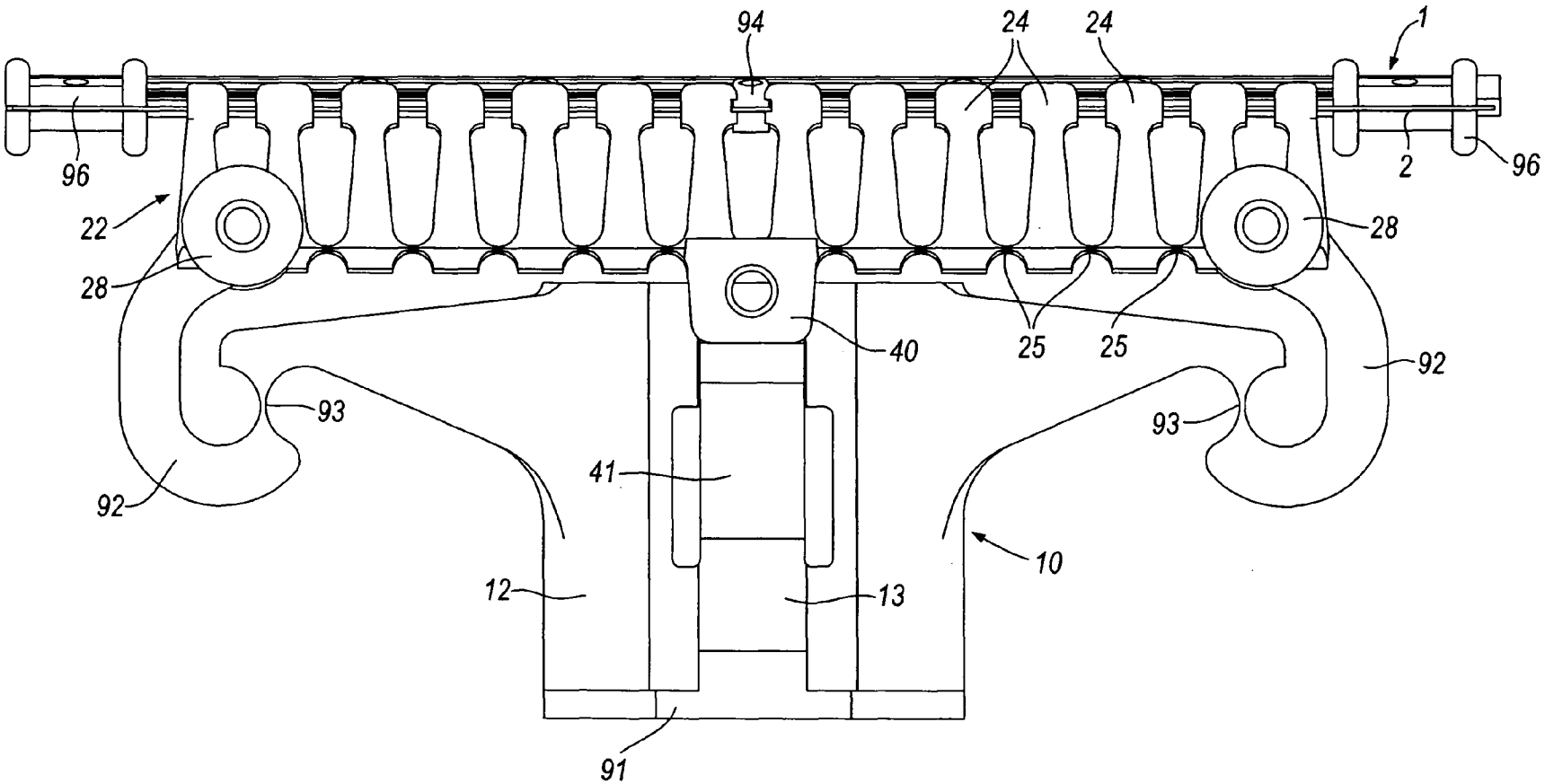
FIG. 34 is a rear elevation of the blade unit shown in FIG. 32.
Figure 35:
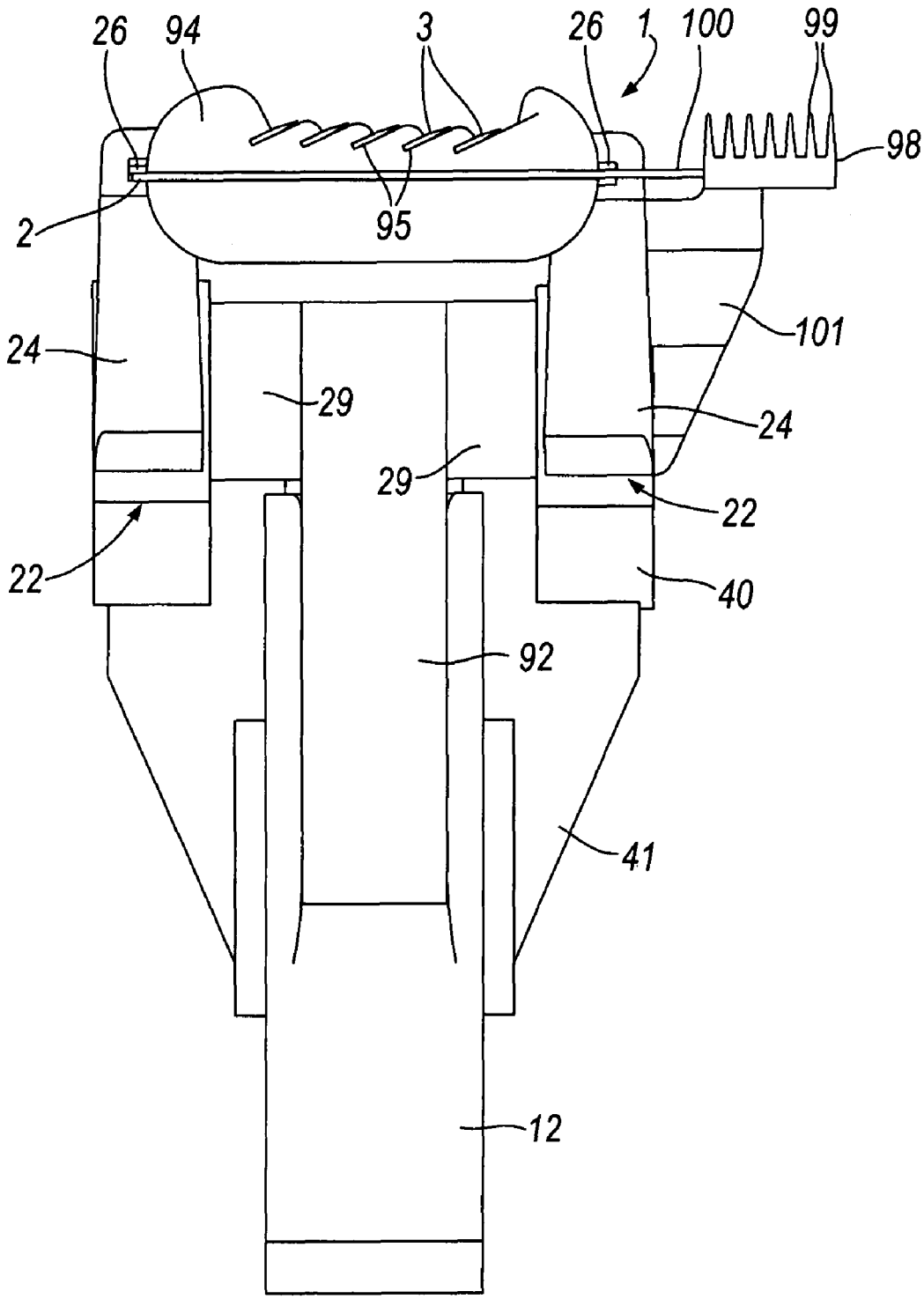
FIG. 35 is an end elevation of the blade unit of FIG. 32.
Figure 36:
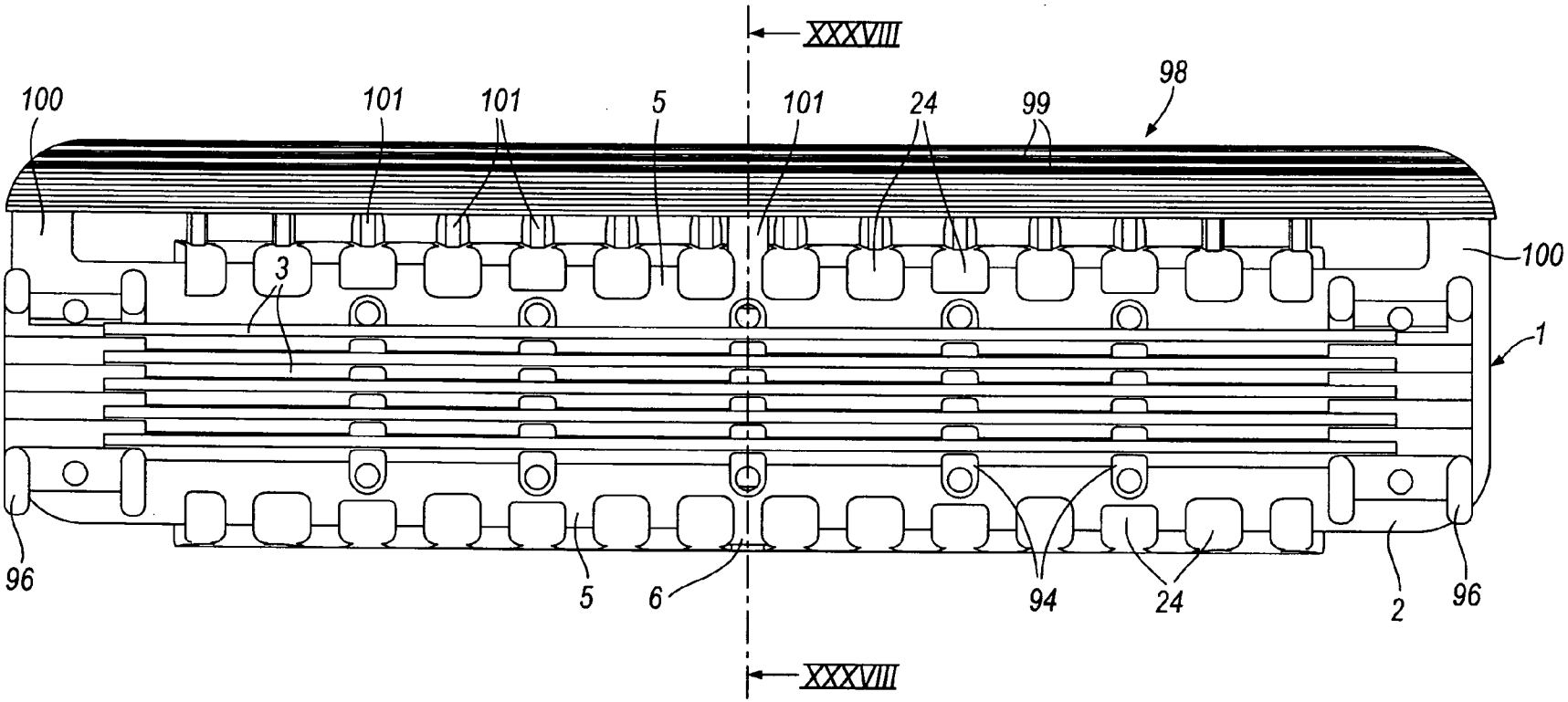
FIG. 36 is a top plan of the blade unit of FIG. 32.
Figure 37:
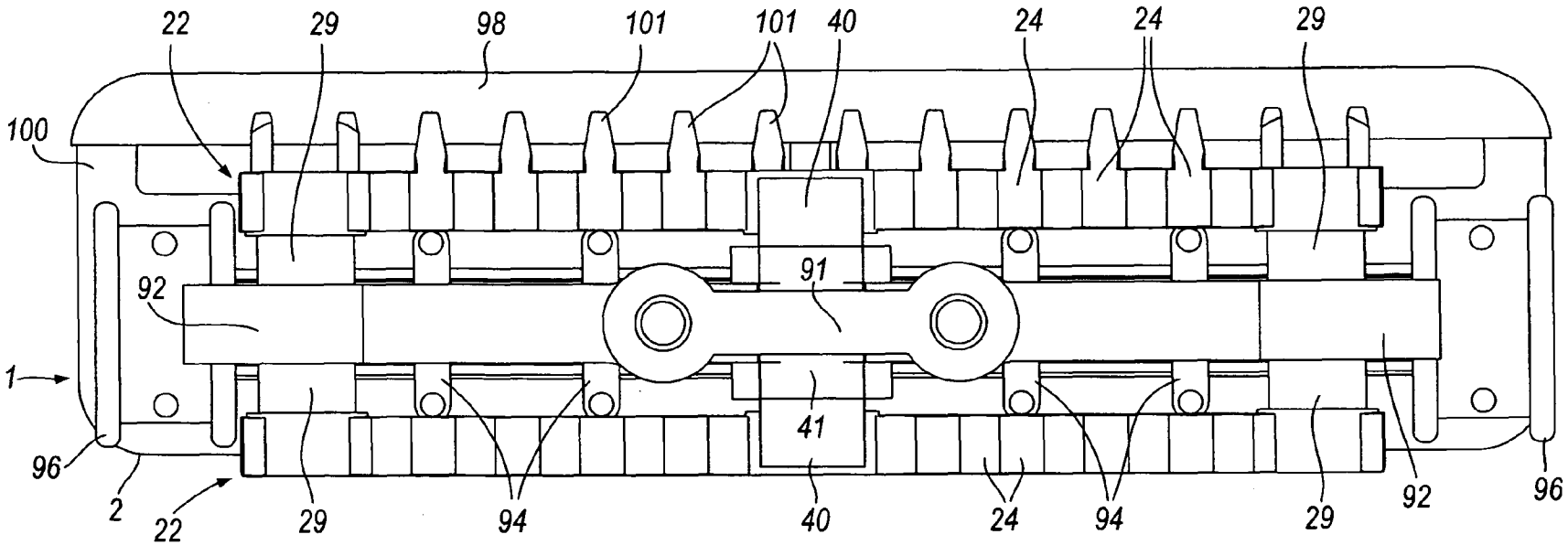
FIG. 37 is an underneath plan of the blade unit of FIG. 32.
Figure 38:
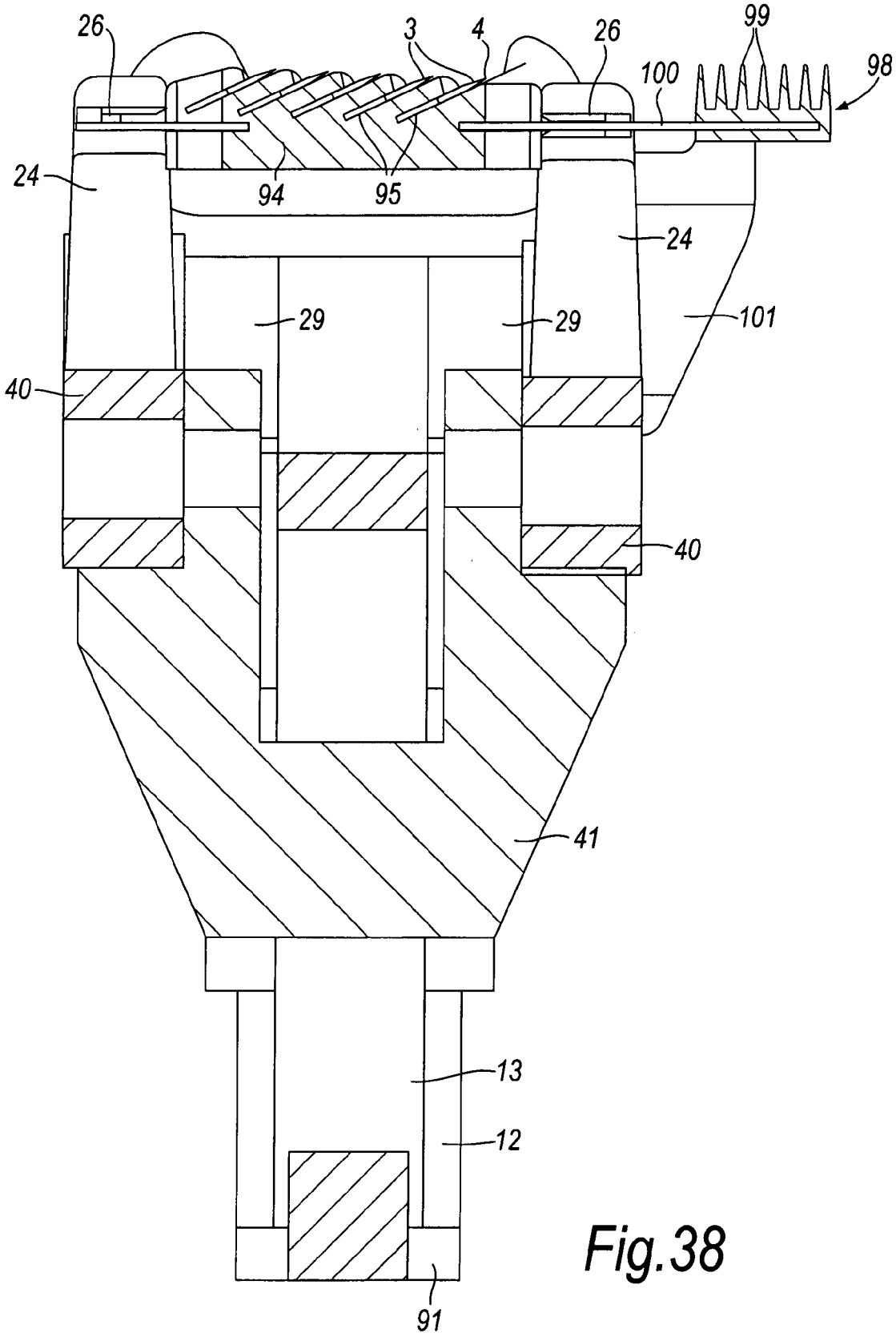
FIG. 38 is a cross section taken along the line XXXVIII-XXXVIII in FIG. 36.

The safety razor blade unit illustrated in FIGS. 17 to 23 is generally similar to the blade unit described above with reference to FIGS. 1 to 16, and the same description applies apart from the modifications that are mentioned below. The front plate 18 of the main frame has two trunnions 20 at its opposite ends for pivotal connection of the blade unit to a razor handle (not shown) to pivot about an axis parallel to the cutting edges of the blades 3 in a manner well known per se. The two spacers 19 of the main frame 15, extending, between the opposed frame plates 18, are integrated into a common spacer member 10 having a central upright part 12 defining a vertical guide slot 13. The depending legs 40 of the respective suspension members 22 have slide blocks 41 that extend towards each other and into the guide slot 13 for the middle sections of the suspension members to be guided for vertical movement. The end regions of the suspensions members 22 are guided by pins 42 engaged in the slots 38 in exactly the same way as in the first embodiment described above, although the pins 42 are not shown in FIGS. 17 to 23. By virtue of the guiding arrangement between the supporting structure 14 and the main frame 15 the upper ends of the support elements 24 and the flexible blade structure 1 carried thereon are able to adapt to conform to both convex and concave curvatures as explained above in connection with the blade unit of FIGS. 1 to 11. The blade structure 1 in this embodiment includes in addition to the substantially sheet-like base frame 2 and the flexible blades 3 (there being four blades in this embodiment), an elastomeric guard member or strip 30, with a series of upstanding parallel fins 31, molded in situ onto the base frame. The guard strip 30 is highly flexible and does not impede flexing of the blade structure 1. A body part of the guard strip can be located on the underside of the base frame 2 with only upwardly projecting parts, such as the fins 31 and a backstop element 32 located above the top surface of the base frame. The edge portions 5 of the base frame 2 are supported by the support elements 24 as in the first embodiment of FIGS. 1 to 11, and the guard strip 30 is located between that edge portion which is engaged with the support elements 24 of the suspension member 22 at the front of the blade unit, and the blades 3. As depicted in FIG. 22, the parts of the elastomeric guard strip protruding above the frame plate can be separated into a plurality of segments along the blade structure and if desired the guard segments can separately formed.

The third embodiment of a safety razor blade unit illustrated in FIGS. 24 to 31 includes a main frame 15 with front and rear plates 18 interconnected by an integral spacer member 10 of the same form as that of the second embodiment described above and including spacers 19 and a central guide part 12 defining a guide slot 13. Thus the series of linked support elements 24 of the supporting structure are guided for movement in the same way as in the previous embodiment although once again the guide pins 42 which are slidably engaged in the guide slots 38 of the frame plates 18 are not shown in the drawings.

In the blade unit shown in FIGS. 24 to 31 the blade structure 1 comprises a set of five individual blades 3 separately mounted on the supporting structure 14. The supporting structure includes symmetrically opposed suspension members 22 each having a series of support elements 24, with adjacent support elements 24 in each series being linked by integral hinges 25, but in this embodiment the upper ends of each opposed pair of support elements are interconnected by support bridges 45 integral with the support elements 24. Formed on each of the bridges are blades seats 46 for receiving the respective blades, and blade retaining fingers 47 disposed above and alongside the seats to engage over blades positioned on the seats. The seats 46 and the fingers 47 together define slots to receive the blades. The blades seats 46 are forwardly and upwardly inclined to set the blades 3 at a desired angle with the cutting edges 4 uppermost, which allows substantially planar narrow blades 3 to be employed without any need for any special shaping, e.g. in the manner described above in connection with FIGS. 12 to 16. If desired, however, the blade seats 46 could be made flat and bent blades as included in the first and second embodiments could be fitted onto the flat blade seats. Connected to, and conveniently formed in one piece with the blade support bridges 45 at the opposite ends of the supporting structure are end members 48 with notches 49 to receive the ends of the respective blades. Metal blade retainer clips (not shown) are wrapped around the end members 48 and the blade ends positioned thereon to retain the blades on the supporting structure and to prevent the blades becoming dislodged from the blade seats 46. To avoid any undesirable longitudinal movement of the blades 3 relative to the supporting structure 14, the blades are provided with detent teeth 6 which project from the rear edges of the blades and engage between two blade seats 46 so that the blades are held at central positions along their length without impeding sliding movement between the blades and the blade seats at positions away from the central location. The slide block 41 which is engaged in the guide slot 13 of the central part 12 of the spacer member 10 is fixedly connected to the legs 40 of the suspension members 22 after having been inserted through the guide slot 13.

The blade unit of FIGS. 24 to 31 includes a separate skin contact member 70 mounted on the supporting structure 14. This skin contact member could be a guard member for engagement with the skin in front of the blades in the performance of a shaving stroke with the blade unit, but in the construction shown in the drawings the skin contact member 70 is a cap member for contact with the skin behind the blades and it comprises a flexible lubricating strip 71 carried on a flat flexible plate 72 having longitudinal edges 73 in front of and behind the lubricating strip. The suspension member 22 positioned adjacent the rear frame plate 18 has support elements 24 formed with upstanding portions 74 providing support faces, and fingers 75 located above these support faces and confining therewith slots 76 in which the longitudinal edges of 73 of the carrier plate 72 are slidably received. The longitudinal edges have detent teeth 77 projecting from their midportions to engage in notches defined between a pair of adjacent support elements 24 to hold the skin contact member against undesirable movement longitudinally of the supporting structure 14 of the blade unit. It will be appreciated that the skin contact member 70 is able to flex to follow the flexing of the blade structure 1 constituted by the individual blades 3 in the specific construction shown when the support elements 24 move for the blade unit to conform to concave or convex skin surface contours.

The support elements 24 of the suspension member 22 located in juxtaposition to the front frame plate 18 have guard segments 80 with upstanding fins 81 supported on their upper ends. The guard segments 80 are conveniently molded in situ from an elastomeric material and can be inter-connected by flexible webs 82 formed with U-shaped profiles so that the webs do not impede relative movement between the upper ends of the adjacent support elements 24.

The embodiment of the invention illustrated in FIGS. 32 to 38 excludes a main frame with front and rear plates, and instead is provided with a spacer member 10 which supports the deformable supporting structure and is arranged to provide guidance to control the relative movements of the support elements 24. Two symmetrically opposed suspension members 22 are located on opposite sides, that is adjacent the front and rear of the spacer member, and as in the previous embodiments each suspension member including a series of support elements 24 linked together by hinged connections 25. A flexible blade structure 1 is mounted on the upper ends of the support elements and has a flat base frame 2 with longitudinal edge portions 5 engaged in slots 26 provided in the free upper ends of the support elements 24. The blade structure is described in further detail below. The bosses 28 provided at the ends of the suspension members have extensions 29 which act as spacers between the suspension members and the spacer member 10. Fastening elements (not shown) are inserted through the bosses 28 and their extensions 29 and pass through holes 90 in the spacer member 10 to hold the assembly together. The spacer member 10 has a central part 12 with a vertical guide slot 13, the open lower end of which is permanently closed by a gate element 91 after a slide block 41 has been inserted into the guide slot during assembly of the blade unit. The slide block 41 is fixedly connected to the legs 40 depending from the medially located support elements 24 of the two suspension members 22 whereby the centers of the suspension members are guided for vertical movement. Arms projecting from opposite sides of the central part 12 of the spacer member 10 have coupling members 92 connected thereto by integral hinges 93 for pivotal movement of the coupling members whereby their free ends move substantially linearly towards and away from each other as the coupling members 92 pivot about the axes of the hinges 93. The holes 90 through which the fastening elements inserted through the bosses 28 of the suspension members 22 pass are located at the free ends of the coupling members 92 so that the bosses 28, and hence the end regions of the suspension members, are guided for movement substantially linearly towards and away from each other in the longitudinal direction as the support structure 14 deforms to a convex or concave configuration, with the medial portions of the suspension members being guided to move substantially perpendicular to this direction by the engagement of the side block 41 in the guide slot 13.

The blade structure 1 includes the flexible base frame 2 as already mentioned above, and five elongate blades 3. Rather than being connected directly to the base frame as in other embodiments described above, the blades 3 are supported on blade mounts 94 which are secured to the base frame 2 and extend between the edge portions 5 at positions spaced apart therealong. The blade mounts 94 have inclined slots 95 in which the blades are respectively received to permit sliding movement between the blades 3 and the mounts 94. End members 96 with similar slots 97 are provided at the ends of the base frame and clips (not shown) are wrapped over these end members to retain the blades securely in the slots 95, 97.

The blade structure includes an elastomeric guard member 98 with upstanding fins 99 carried by a base frame extension part connected to the edge portion 5 at the front of the blade structure by forwardly projecting frame pieces 100 spaced apart along this edge portion. The guard member 98 can be of the same general structure form as the guard member 30 described above in connection with the embodiment of FIGS. 17 to 23. To provide additional support for the guard member forwardly directed lugs 101 are provided on the support elements 24 of the front suspension member 22 and have upwardly facing surfaces on which the underside of guard member 98 rests.

It will be understood that a cap member such as a lubricating strip could be similarly provided on the blade structure 1, at the rear side thereof, either as well as or instead of the guard member 98 at the front side of the blade structure. Also, a segmented lubricating strip or other form of cap member, could be molded onto the supporting elements 24 to the rear of the blade structure 1 in similar manner to the way in which the segmented guard is molded onto the support elements at the front of the blade structure in the embodiment shown in FIGS. 24 to 30.

The described safety razor blade units described above are capable of conforming to skin contours ensuring shaving contact along the blades even when fairly sharp curvatures, such as in the region of a jawbone are encountered, and as a result an improved shaving efficiency can be achieved.

It should be understood that the foregoing description of the preferred embodiment is given by way of non-limiting example only and that modifications and variations are possible without departing from the scope of the invention as defined by the claims which follow. In addition, features described in relation to specific embodiments can be included in other embodiments. Thus, the different forms of blade structure included in the respective embodiments can be utilized with the various forms of supporting structures and guiding arrangements incorporated in other blade unit embodiments.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An assembly in or for a safety razor, said assembly comprising an elongate flexible blade structure comprising one or more elongate flexible blades, said blade structure is carried on a supporting structure that is deformable to permit the blade structure to flex, and the supporting structure comprises a series of support elements spaced apart along the blade structure and so linked together by hinged connections that the blade structure can flex to follow concave or convex curvatures along the length thereof, wherein the supporting structure comprises a vertical guide slot and a pair of longitudinally aligned guide slots perpendicular to the vertical guide slot that facilitate sliding cooperation between the blade structure and the supporting structure.

2. The assembly according to claim 1, wherein the support elements are uniformly spaced apart along the blade structure.

3. The assembly according to claim 1, wherein the support elements extend from the hinged connections to a free end where the blades structure is supported.

4. The assembly according to claim 1, wherein the blade structure has a detent for engaging the supporting structure to retain the blade structure against longitudinal movement relative to the supporting structure.

5. The assembly according to claim 4, wherein the detent is located at a medial position along the blade structure.

6. The assembly according to claim 1, wherein a guide arrangement is provided to guide relative movement of the support elements for controlling deformation of the supporting structure.

7. The assembly according to claim 6, wherein the guide arrangement comprises a frame in which the supporting structure is mounted.

8. The assembly according to claim 6, wherein at least two of the support elements are guided for displacement along substantially linear paths.

9. The assembly according to claim 8, wherein the at least two support elements are guided for substantially aligned movement in a longitudinal direction, and a further support element is guided for movement in a direction substantially perpendicular to the longitudinal direction.

10. The assembly according to claim 1, wherein a series of two support elements are provided for supporting the blade structure.

11. The assembly according to claim 1, wherein at least one of the support elements is formed by a one piece suspension member.

12. The assembly according to claim 1, wherein the blade structure comprises a plurality of individual blades independently mounted on the supporting structure.

13. The assembly according to claim 1, wherein the support elements comprise a plurality of slots, a side edge portion of the blade structure is received in and slidably guided by the slots.

14. The assembly according to claim 1, wherein the blade structure includes a flexible base frame having an edge portion engaged with the support elements and at least one elongate blade connected to the flexible base frame at a plurality of positions along the blade.

15. The assembly according to claim 14, wherein the base frame comprises a pair of opposed edge portions interconnected by bridging strips and by end strips to which the at least one blade is connected.

16. The assembly according to claim 15, wherein the at least one blade is fixedly connected directly to the base frame.

17. The assembly according to claim 1, wherein a guide member is disposed adjacent the supporting structure and includes a rigid central part with a pair of opposed arms extending from the central part.

18. The assembly according to claim 1, wherein the supporting structure additionally supports a skin contact member separate from the blade structure.

19. The assembly according to claim 1, wherein the support elements of the supporting structure carry a respective segment of a skin contacting member.

* * * * *